US005862871A

United States Patent [19]

Curlett

[11] Patent Number: 5,862,871

[45] Date of Patent: Jan. 26, 1999

[54] AXIAL-VORTEX JET DRILLING SYSTEM AND METHOD

[75] Inventor: Harry B. Curlett, Dallas, Tex.

[73] Assignee: Ccore Technology & Licensing Limited, A Texas Limited Partnership, Dallas, Tex.

[21] Appl. No.: 603,734

[22] Filed: Feb. 20, 1996

[51] Int. Cl.[6] ..... E21B 10/60

[52] U.S. Cl. ..... 175/340; 175/424; 239/463; 239/487

[58] Field of Search ..... 175/340, 393, 175/424; 239/463, 487

[56] References Cited

U.S. PATENT DOCUMENTS

| | | | |
|---|---|---|---|
| 1,868,400 | 11/1932 | Stover . | |
| 2,526,220 | 10/1950 | Goddard | 239/406 |
| 2,701,122 | 2/1955 | Grable . | |
| 2,786,652 | 3/1957 | Wells . | |
| 2,815,248 | 12/1957 | O'Brien | 299/114 |
| 3,065,807 | 11/1962 | Wells | 175/321 |
| 3,112,800 | 12/1963 | Bobo | 175/67 |
| 3,123,159 | 3/1964 | Buck | 175/67 |
| 3,208,539 | 9/1965 | Henderson | 175/215 |
| 3,237,705 | 3/1966 | Williams | 175/406 |

(List continued on next page.)

FOREIGN PATENT DOCUMENTS

| | | | |
|---|---|---|---|
| 047635 2A1 | 3/1992 | European Pat. Off. . | |
| 0 671 216 | 9/1995 | European Pat. Off. . | |
| 94 15 124 | 11/1994 | Germany . | |
| 309111 | 9/1971 | U.S.S.R. | 175/346 |
| 664691 | 5/1979 | U.S.S.R. | 239/487 |
| 829850 | 5/1981 | U.S.S.R. . | |
| 892905 | 4/1962 | United Kingdom . | |
| 2 224 054 | 9/1988 | United Kingdom . | |
| 2 277 758 | 5/1993 | United Kingdom . | |
| 95/10684 | 4/1995 | WIPO . | |

OTHER PUBLICATIONS

"A Model Study of the Water Pressure Distributed in a Crack When Impacted by a High Pressure Water Jet"; by Dr. M. Mazurkiewicz, Dr. J. white, Dr. G. Galecki; *Ninth International Symposium on Jet Cutting Technology*, Sep. 9–11, 1986; Paper 18, pp. 198–193.

"A New Look at Bit Flushing"; by C.R. Peterson and M. Hood; *Gas Research Institute*; Aug. 1990.

*Advanced Drilling Techniques*; by W. C. Mauer; pp. 21, 61, 71, 96, 227, 247, 276, 281, 287, 289, 302, 451, 477, 506, 517–528, 594, 612, 624, 671, and 682–692. (Undated).

*Advanced Drilling Techniques*; Chapter 14: "High Pressure Jet–Assisted Mechanical Drills"; by William C. Mauer; 1981.

"An Analysis of Field–Warren TSD Cutting Elements"; by Zhong Liu and G. A. Cuther; *PED–vol. 4, Drilling Technology, ASME 1992*; pp. 23–33.

"Certain Chosen Problems of Hydro–Mechanical Mining With Disc Drills"; A. Klich, K. Kotwca, and M. Mazurkieicz; *Seventh Annual Water Jet Conference*; Oct. 28–31, 1993, Seattle, Washington, Paper 35.

"Conical Water Jet Drilling"; W. Dickinson, R.D. Wilkes. and R.W. Dickinson; Proceedings of the Fourth U.S. Water Jet Conference; Oct. 28, 1987, pp. 89–96.

"Development of High–Pressure Abrasive–Jet Drilling"; J.C. Fair, *Journal of Petroleum Technology*, Aug., 1981, pp. 13, and 79–88.

(List continued on next page.)

*Primary Examiner*—David J. Bagnell
*Attorney, Agent, or Firm*—Jenkens & Gilchrist, A Professional Corporation

[57] ABSTRACT

A drill bit with a housing and roller cones has a high-speed fluid jet erosion system utilizing dual discharge, high-velocity, jet streams that is directed at the surface to be eroded. The jet streams are developed from a dual discharge nozzle adapted to form a first, swirling liquid jet and a second, axial liquid jet in combination therewith. When used in a shale-like formation, the bit includes a nozzle in a bowl area of the housing that sends a vortex shaped spray against the roller cones.

121 Claims, 7 Drawing Sheets

U.S. PATENT DOCUMENTS

| | | | |
|---|---|---|---|
| 3,251,424 | 5/1966 | Brooks | 175/56 |
| 3,324,957 | 6/1967 | Goodwin et al. | 175/67 |
| 3,326,473 | 6/1967 | Wahlin | 239/468 |
| 3,385,386 | 5/1968 | Goodwin et al. . | |
| 3,389,759 | 6/1968 | Mori et al. | 175/258 |
| 3,414,070 | 12/1968 | Pekarek | 175/393 |
| 3,417,829 | 12/1968 | Acheson et al. | 175/67 |
| 3,424,255 | 1/1969 | Mori et al. | 175/60 |
| 3,469,642 | 9/1969 | Goodwin et al. | 175/393 |
| 3,528,704 | 9/1970 | Johnson, Jr. | 299/14 |
| 3,542,142 | 11/1970 | Hasiba et al. . | |
| 3,545,552 | 12/1970 | Angoma | 175/65 |
| 3,548,959 | 12/1970 | Hasiba | 175/393 |
| 3,552,779 | 1/1971 | Henderson | 285/133 |
| 3,596,720 | 8/1971 | Elenburg | 175/69 |
| 3,603,410 | 9/1971 | Angona | 175/65 |
| 3,674,100 | 7/1972 | Becker | 175/69 |
| 3,838,742 | 10/1974 | Juvkam-wold | 175/380 |
| 4,047,580 | 9/1977 | Yahiro et al. | 175/67 |
| 4,068,731 | 1/1978 | Garner et al. | 175/339 |
| 4,125,226 | 11/1978 | Nieuwkamp | 239/468 |
| 4,131,236 | 12/1978 | Saunders | 239/589 |
| 4,174,759 | 11/1979 | Arbuckle | 175/67 |
| 4,185,706 | 1/1980 | Baker, III et al. | 175/340 |
| 4,187,921 | 2/1980 | Garner | 175/340 |
| 4,193,635 | 3/1980 | Thiruvengadan et al. | 299/17 |
| 4,219,087 | 8/1980 | Johnson | 175/65 |
| 4,244,521 | 1/1981 | Guse | 239/110 |
| 4,262,757 | 4/1981 | Johnson, Jr. et al. | 175/67 |
| 4,280,735 | 7/1981 | Löbbe . | |
| 4,306,627 | 12/1981 | Cheung et al. . | |
| 4,319,784 | 3/1982 | Claringbull | 299/64 |
| 4,337,899 | 7/1982 | Selberg | 239/543 |
| 4,343,371 | 8/1982 | Baker, III et al. . | |
| 4,359,115 | 11/1982 | Cagnioncle | 175/393 |
| 4,389,071 | 6/1983 | Johnson, Jr. et al. | 299/14 |
| 4,391,339 | 7/1983 | Johnson, Jr. et al. | 175/393 |
| 4,474,251 | 10/1984 | Johnson, Jr. | 175/67 |
| 4,534,427 | 8/1985 | Wang et al. | 175/67 |
| 4,542,798 | 9/1985 | Madigan | 175/340 |
| 4,570,860 | 2/1986 | Aprea et al. | 239/478 |
| 4,610,321 | 9/1986 | Whaling . | |
| 4,624,327 | 11/1986 | Reichman | 175/67 |
| 4,660,773 | 4/1987 | O'Hanlon | 239/596 |
| 4,664,314 | 5/1987 | O'Brien et al. | 239/469 |
| 4,676,563 | 6/1987 | Curlett et al. | 439/194 |
| 4,681,264 | 7/1987 | Johnson, Jr. | 239/589.1 |
| 4,683,944 | 8/1987 | Curlett | 166/65.1 |
| 4,683,994 | 8/1987 | Curlett | 166/65.1 |
| 4,687,066 | 8/1987 | Evans | 175/340 |
| 4,723,612 | 2/1988 | Hicks | 175/393 |
| 4,733,735 | 3/1988 | Barr et al. | 175/393 |
| 4,739,845 | 4/1988 | Dennis | 175/340 |
| 4,759,415 | 7/1988 | Pessier | 175/340 |
| 4,765,687 | 8/1988 | Parrott | 299/81.1 |
| 4,784,231 | 11/1988 | Higgins | 175/340 |
| 4,787,465 | 11/1988 | Dickinson, III et al. | 175/67 |
| 4,799,544 | 1/1989 | Curlett | 166/65.1 |
| 4,819,516 | 4/1989 | Dennis . | |
| 4,836,305 | 6/1989 | Curlett | 175/215 |
| 4,852,668 | 8/1989 | Dickinson, III et al. | 175/67 |
| 4,902,073 | 2/1990 | Tomlinson et al. . | |
| 4,924,949 | 5/1990 | Curlett | 175/25 |
| 5,199,512 | 4/1993 | Curlett | 175/67 |
| 5,217,163 | 6/1993 | Henshaw | 239/101 |
| 5,291,957 | 3/1994 | Curlett | 175/67 |
| 5,297,639 | 3/1994 | Schneider et al. | 175/65 |
| 5,542,486 | 8/1996 | Curlett | 175/424 |

OTHER PUBLICATIONS

"Experimental Studies on Deep–Ocean Cutting With Abrasive Jet Systems"; D.G. Alberts, M. Hashish, and R.C. Lilley; *Quest Integrated, Inc.*, pp. 711–722. (Undated).

"Experiments Concerning the Vortex Whistle"; by R.C. Chanaud; *The Acoustical Society of America*, Mar. 25, 1963, pp. 953–960.

"Evaluation of High Pressure Drilling Fluid Supply Systems"; by M.C. McDonald, J.M. Reichman, K.J. Theimer; *DOE Contrat DE–AC 04–76DP00789*, Oct., 1981.

"Five Wells Test High Pressure Drilling"; by F.H. Deily, J.K. Heilhecker, W.C. Maurer, and W.W. Love; *The Oil & Gas Journal*; Jul. 4, 1977, pp. 74–81.

"High Pressure Drilling System Triples ROPS, Stymies Bitwear"; M. Killalea, Editor; *Drilling*, Mar./Apr. 1989, pp. 10–12.

"Hydro–Blast Mining Shoots Ahead"; A.B. Fly; *Mining & Engineering*, Mar., 1969.

*Jet Cutting Technology*; by Lichtarowicz; *Kluwer Academic Publishers*, 1992.

"Laboratory Testing of High Pressure, High Speed PDC Bits"; W.C. Maurer, W.J. McDonald, J.H. Cohen, and B.W. Carroll; *SPE Paper 15615*, Oct. 1986.

"More Than Just the Right Tools"; *BDC General Catalogue*, pp. 11, 19–21, and 27. (Undated).

"New Gulf Method of Jetted–Particle Drilling Promises Speed and Economy"; *The Oil & Gas Journal*, Jun. 21, 1971.

"Recent Advances in Polychrystalline Diamond 'PCD' Technology Over New Frontiers in Drilling"; by M.V. Smeedon and D.R. Hall; *SPE 17007*, Sep. 27–30, 1987, pp. 487–498.

"Research and Development of a High–Pressure Water Jet Coring Device for Geothermal Exploration and Drilling"; J.M. Reichman; *DOE Contract No. EY–76–C–06–2325*, Jan., 1978.

"Technical Data: The Hughes Christensen Vortex Center Jet"; *Hughes Christensen Pamphlet*. (Undated).

"Tests Show Jet Drilling Has Promise"; R. Feenstra, A.C. Pols and J. VanSteveninck; *The Oil & Gas Journal*; Jul. 1, 1994, pp. 45–57.

"The Development of Structured Cavitating Jets for Deep–Hole Bits"; Johnson, Jr., et al.; *Society of Petroleum Engineers, SPE 11060*, Sep. 1982.

"The Effect of Porosity on Hydraulic Rock Cutting"; S.C. Crow; *Int. J. Rock Mech. Min. Sci. & Geomech.*, Abst. vol. 11, pp. 103–105, 1974.

"Water–Jet–Assisted Drag Bit Cutting in Medium Strength Rock"; by J.E. Geier, M. Hood, and E. Dewey Thimons; *U.S. Department of the Interior, Bureau of Mines, Information Circular 9164*, 1987.

"A Vortex Whistle"; by B. Vonnegut; *The Journal of The Acoustical Society of America*; vol. 26, No. 1, Jan. 1954; pp. 18–20.

*Ultrasonics*; Apr., 1970, pp. 91–92.

"Laser Machining Composites: Just Add Water"; by G. Chryssoloursis and P. Sheng; *Machining Technology*, Third Quarter, vol. 1, No. 2, pp. 1–3 (Undated).

"Materials and Bit Construction"; source unknown; pp. 56–11; 24–25, and 28–31. (Undated).

AXIAL-VORTEX JET DRILLING SYSTEM AND METHOD

BACKGROUND OF THE INVENTION

1. Field of the Invention

The present invention relates to drilling systems and, more particularly, to a method of and apparatus for producing a combination of vortex and axially disposed erosive jet streams for cleaning, cutting, boring, combinations thereof, and the like.

2. History of the Prior Art

Drill bits for drilling bore holes for oil and/or gas production and the like will typically engage the formation and remove particles therefrom. When drilling the bore holes for well production, there are generally at least two types of formations which a drill bit will encounter: relatively soft shale and hard rock.

When the formation is relatively soft, as with shale, material removed by the drill bit will have a tendency to reconstitute onto the teeth of the drill bit. Build-up of the reconstituted formation on the drill bit is called bit balling and will reduce the depth that the teeth of the drill bit will penetrate the bottom surface of the well bore, thereby reducing the efficiency of the drill bit. Particles of a shale formation also tend to reconstitute back onto the bottom surface of the bore hole. The reconstitution of a formation back onto the bottom surface of the bore hole is called bottom balling. Bottom balling prevents the teeth of a drill bit from engaging virgin formation and spreads the impact of a tooth over a wider area, thereby reducing the efficiency of a drill bit. Higher density drilling muds that are required to maintain well bore stability or well bore pressure control exacerbate bit balling and the bottom balling problems. Therefore, there is a need for drill bits which will reduce drill bit balling and bottom balling that occurs when drilling shale-like formations.

When the formation that the drill bit is engaging is of a harder rock, the teeth of the drill bit press against the formation and densify a small area under the teeth to cause a crack in the formation. When the porosity of the formation is collapsed, or densified, in a hard rock formation below a tooth, nozzles of the conventional drill bits do not have enough hydraulic energy to remove the crushed material below the tooth pit when the tooth is removed. As a result, a cushion, or densification pad, of densified material is left on the bottom surface by the prior art drill bits. If the densification pad is left on the bottom surface, force by a tooth of the drill bit will be distributed over a larger area and reduce the effectiveness of a drill bit. Therefore, there is a need for drill bits that have sufficient hydraulic power to remove the crushed material below a tooth pit in a drill bit when the tooth is removed.

SUMMARY

In one embodiment, the present invention comprises a fluid nozzle for use in a drill bit, said nozzle comprising a nozzle housing having a central bore therethrough with a nozzle inlet and an exit orifice, means for generating a low pressure region adjacent to said exit nozzle and means for discharging a portion of fluid passing through said central bore of said nozzle housing as an axial stream passing through the low pressure region generated by said means for generating a low pressure region.

In another embodiment, the present invention comprises a fluid nozzle for use in a drill bit, said nozzle comprising a nozzle housing having a central bore therethrough with a nozzle inlet and an exit orifice, means for discharging a portion of fluid passing through said central bore of said housing as a swirling stream, and means for discharging a portion of fluid passing through said central bore of said housing as an axial stream passing through the swirling stream discharged by said means for discharging a swirling stream.

In another embodiment, the present invention comprises a housing adapted for movement relative to a surface, means associated with the housing for the flow of fluid therethrough, means associated with said housing for imparting mechanical force to the surface, and at least one dual discharge fluid nozzle disposed in said housing and positioned in fluid communication with said fluid flow means for the discharge of a first, swirling fluid stream and a second, axial fluid stream in combination therewith.

BRIEF DESCRIPTION OF THE DRAWINGS

For a more detailed description of the construction and operation of the present invention, reference is now made to the following description taken in conjunction with the accompanying drawings, in which.

DETAILED DESCRIPTION

Figure 1:
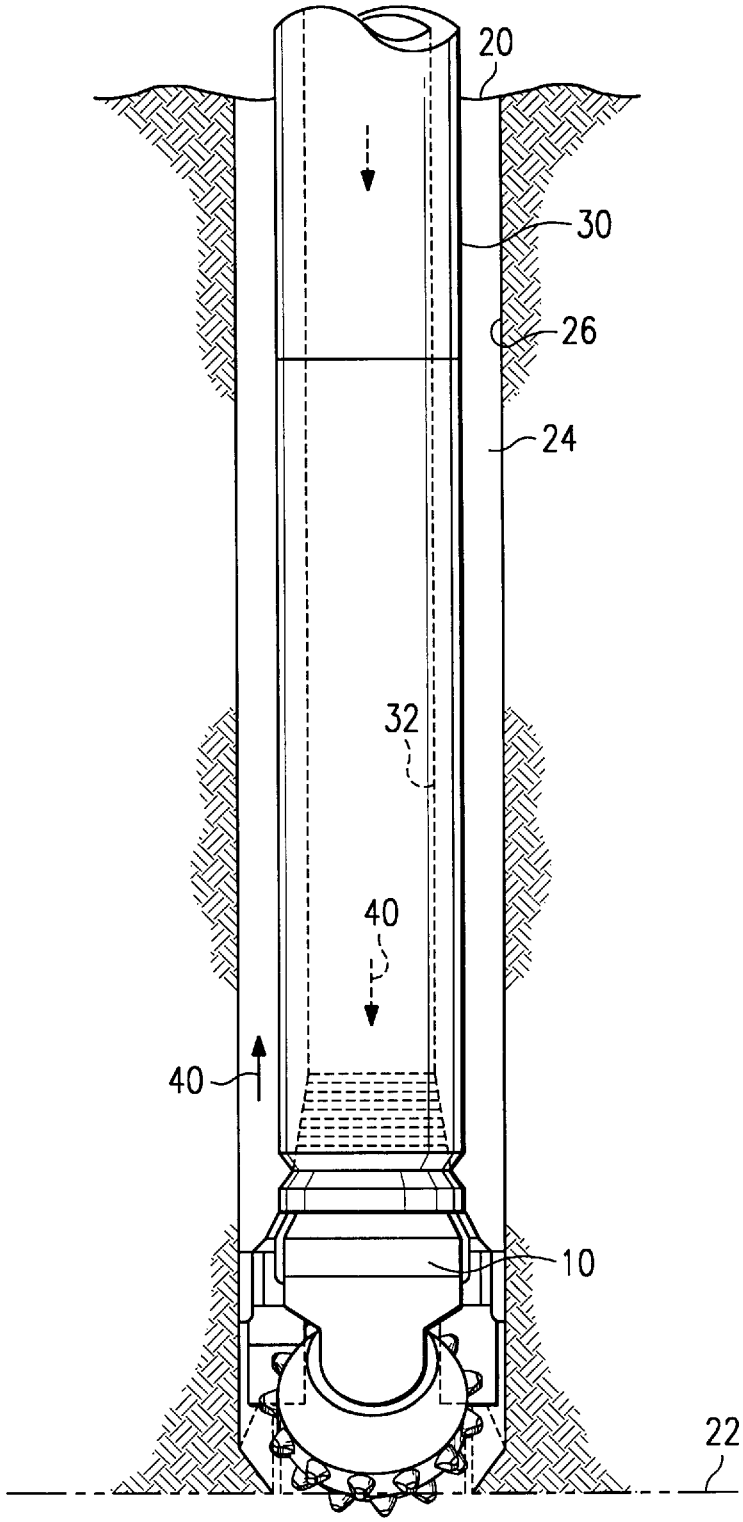
FIG. 1 is a fragmentary and elevational view of a well bore utilizing an embodiment of the present invention.

A drill bit 10 is shown in FIG. 1 at the bottom of a well bore 20 and attached to a drill string 30. The drill bit 10 acts upon a bottom surface 22 of the well bore 20. The drill string 30 has a central passage 32 that supplies drilling fluids to the drill bit 10. The drill bit 10 uses the drilling fluids 40 when acting upon the bottom surface 22 of the well bore 20. The drilling fluids 40 that have been used by the drill bit 10 on the bottom surface 22 of the well bore 20 exit the well bore 20 through a well bore annulus 24 between the drill string 30 and the outer walls 26 of the well bore 20. Particles of the bottom surface 22 removed by the drill bit 10 exit the well bore 20 with the drill fluid 40 through the well bore annulus 24.

Figure 2:
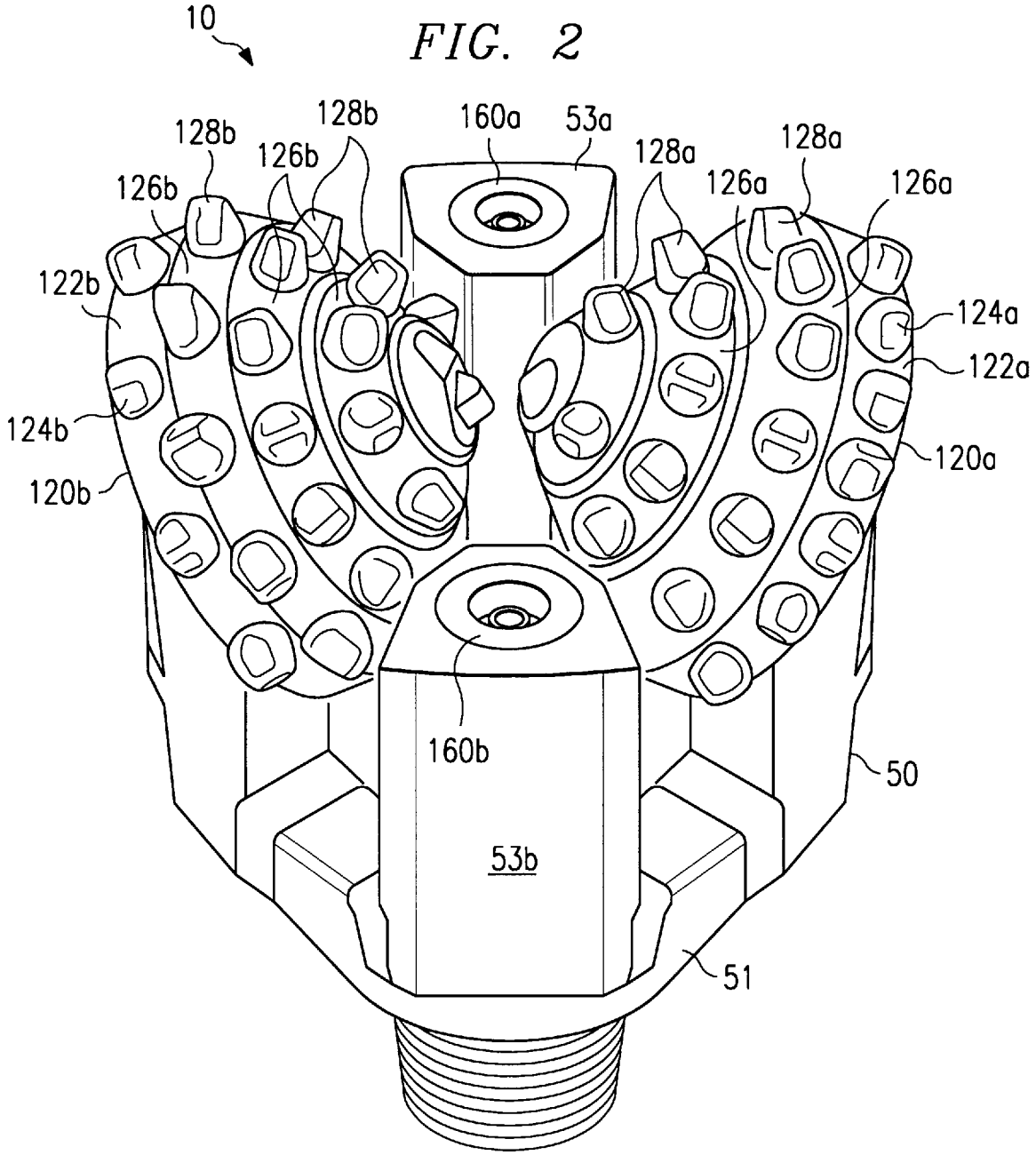
FIG. 2 is an enlarged perspective view of the drill bit in FIG. 1, illustrating in more detail the construction thereof.

One embodiment of the drill bit 10, as illustrated in FIG. 2, generally comprises roller cones 120*a* and 120*b*, a housing 50, and nozzle assemblies 160*a* and 160*b*. The roller cones 120*a* and 120*b* comprise a series of rows having teeth thereon, each row having a smaller diameter such that the series of rows form a cone shape. The outer or heel rows 122*a* and 122*b* have heel row teeth 124*a* and 124*b* thereon. The inner rows 126*a* and 126*b* have inner row teeth 128*a* and 128*b* thereon. The housing 50 has a main body 51 and nozzle towers 53*a* and 53*b*. The roller cones 120*a* and 120*b* are rotatably mounted to the main body 51 of the housing 50 such that the point of contact between the roller cones 120*a* and 120*b* and the bottom surface 22 of the well bore 20 is radial to the rotational axis of the housing 50. The nozzle towers 53*a* and 53*b* are reinforced wall sections mounted to the main body 51 of the housing 50 between the roller cones 120*a* and 120*b*. The nozzles 160*a* and 160*b* are mounted in the nozzle towers 53*a* and 53*b*, respectively, and discharge toward the bottom surface 22 of the well bore 20. Although the drill bit 10 is illustrated as having two nozzle tower/nozzle combinations, it is contemplated that the present invention also includes only one nozzle tower/nozzle combination, or more than two nozzle tower/nozzle combinations.

Figure 3:
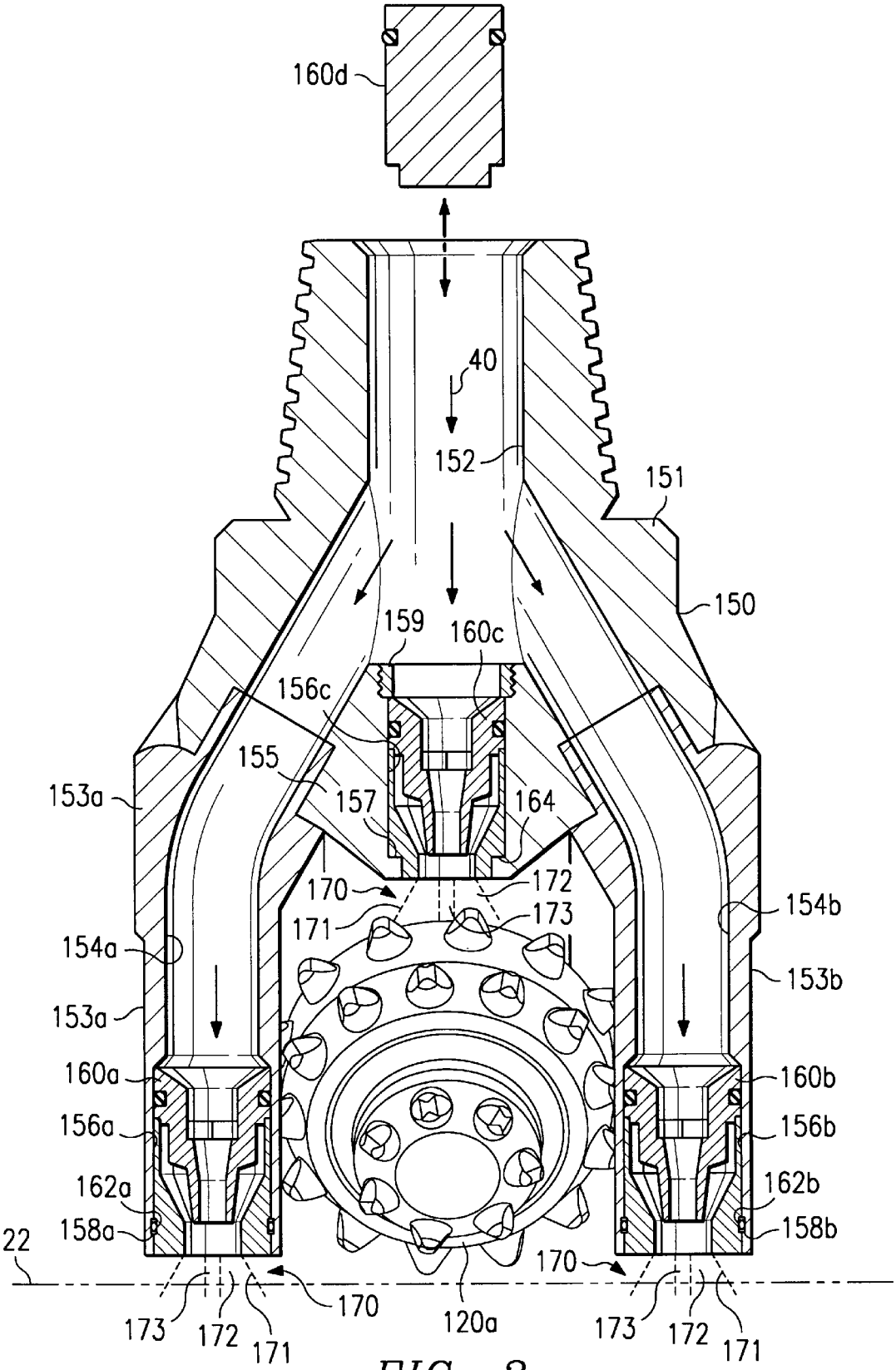
FIG. 3 is a side-elevational cross-sectional view of one embodiment of the drill bit in FIGS. 1 and 2, illustrating the construction thereof in accordance with the principles of the present invention.

In one embodiment of the drill bit 10 used for drilling formations such as shale, the housing is a housing 155, as shown in FIG. 3, having a central bore 152 in a main body 151 for receiving the drilling fluids 40 from the central passage 32 of the drill string 30 (see FIG. 1). The formation nozzle assemblies 160*a* and 160*b* are located within the nozzle apertures 156*a* and 156*b* in nozzle towers 153*a* and 153*b*, respectively, of the housing 150. Branched conduits 154*a* and 154*b* in the housing 150 connect the central bore 152 to the formation nozzles 160*a* and 160*b*, respectively. Locking recesses 158*a* and 158*b* in the housing 150 align with locking recesses 162*a* and 162*b*, respectively, in the formation nozzle assemblies 160*a* and 160*b*. An aluminum nail is inserted to each of the aligned locking recess 158*a* and 158*b* of the housing 150 and locking recesses 162*a* and 162*b*, respectively, of the formation nozzle assemblies 160*a* and 160*b*, thereby securing the formation nozzle assemblies 160*a* and 160*b* within the formation nozzle apertures 156*a* and 156*b* of the housing 150. Other securement techniques are also possible. In this manner, the drilling fluids 40 in the central bore 152 of the housing 150 pass through branch conduits 154*a*, 154*b* to formation nozzle assemblies 160*a*, 160*b*, and the formation nozzle assemblies 160*a*, 160*b* direct the drilling fluids 40 from the branched conduits 154*a*, 154*b* in the housing 150 against the bottom surface 22 of the well bore 20.

A bowl area 155 is located in the main body of the housing 150 below the central bore 152 and between the branched conduits 154*a* and 154*b*. A bowl nozzle aperture 156*c* is located in the bowl 155 of the main body 151 and is in fluid communication with the central bore 152. A stop land 157 in the bowl nozzle aperture 156*c* engages a stop flange 164 on the bowl nozzle assembly 160*c*. A threaded retainer sleeve 159 retains the bowl nozzle assembly 160*c* within the bowl nozzle aperture 156*c* of the housing 150. Other securement techniques are also possible. In this manner, drilling fluids 40 in the central bore 152 of the housing 150 are directed by the bowl nozzle assembly 160*c* outward from the bowl area 155 of the housing 150 and against the roller cones 120*a* and 120*b*.

The formation nozzle assemblies 160*a* and 160*b* in the housing 150 are dual discharge nozzles that discharge against the adjacent formation 22 with a dual discharge output 170 having a swirling vortex flow 171, with a generally cone-shaped profile, and an axial flow 173. The high speed swirling flow creates a low pressure region 172 in the center of the discharged vortex flow 171. The low pressure region 172 in the center of the swirling vortex 171 facilitates the discharge of the axial jet stream 173 therethrough. In a preferred embodiment, the formation nozzle assemblies 160*a* and 160*b* in the drill bit 200 are mounted within about ½ a nozzle diameter to about 10 nozzle diameters of the adjacent formation 22, depending upon the desired use of the jet form attributes.

The bowl nozzle assembly 160*c* in the housing 150 is also a dual discharge nozzle that discharges with a dual discharge output 170 having a swirling vortex flow 171, with a generally cone-shaped profile, and an axial flow 173. The cone-shaped swirling vortex flow 171 fans out and engages roller cones 120*a* and 120*b*. Although the bowl nozzle assembly 160*c* is illustrated herein as a dual jet nozzle, it is contemplated that the present invention also includes having a simple vortex nozzle as the bowl nozzle 160*c* or a simple axial nozzle as the bowl nozzle 160*c*.

In a conventional shale drilling bit, less than 15 percent of the flow through the bit is used by the bit for removing bit balling, and typically only 7 to 10 percent of the total flow through the bit. However, it has been demonstrated by the inventor that dedicating flows greater than 15 percent to the purpose of cleaning the cones to mitigate cone balling has been necessary.

In accordance with the principles of the present invention, conventional drill bit housings can be modified to accommodate the drill bit configurations of the present invention. Conventional housings having nozzle positions projecting on either side of the roller cone can be adapted for use as the housing 150 by modifying the conventional housings to accommodate the dual jet nozzle bosses 153*a* and 153*b* and the dual jet nozzle assemblies 160*a* and 160*b*, positioning the nozzle assemblies 160*a* and 160*b* to the proper location for the housing 150, modifying the bowl region to accommodate the bowl nozzle assembly 160*c*, and positioning the bowl nozzle assembly 160*c* to the proper location for the housing 150. One such prior art drill bit housing assembly, is set forth and shown in U.S. Pat. No. 4,068,731, entitled "EXTENDED NOZZLE AND BIT STABILIZER AND METHOD OF PRODUCING" and issued to Garner et al on Jan. 17, 1978. Also, the dual jet nozzle assembly 160*a* or 160*b* can be fabricated in a size to allow them to be exchanged for the existing conventional axial jet nozzles typically found in single cone, two cone, three cone, four cone and fixed cutter drill bits.

Figure 4:
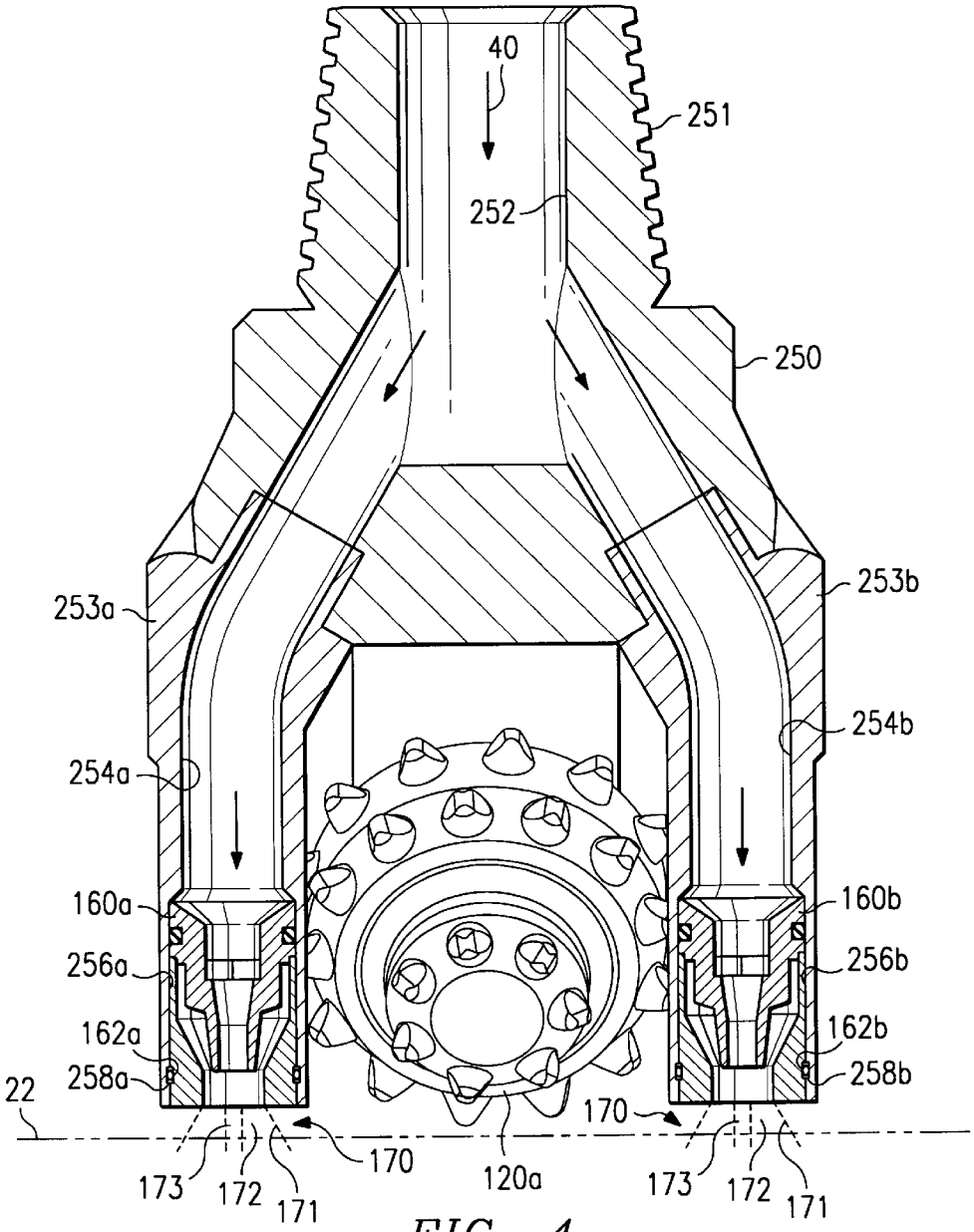
FIG. 4 is a side-elevational cross-sectional view of another embodiment of the drill bit in FIGS. 1 and 2, illustrating construction thereof in accordance with the principles of the present invention.

In another embodiment of the drill bit 10 for use in formations such as hard rock, the housing 50 is a housing 250, as shown FIG. 4, having a central bore 252 in a main body 251 for receiving the drilling fluids 40 from the central passage 32 of the drill string 30 (see FIG. 1). The nozzle assemblies 160*a* and 160*b* are located within nozzle apertures 256*a* and 256*b* in nozzle towers 253*a* and 253*b*, respectively, of the housing 250. Branched conduits 254*a* and 254*b* in the housing 250 connect the central bore 252 to the nozzles 160*a* and 160*b*, respectively. Locking recesses 258*a* and 258*b* in the housing 250 align with locking recess 162*a* and 162*b*, respectively, in the nozzle assemblies 160*a* and 160*b*. An aluminum nail is inserted into each of the aligned, locking recess 258*a* and 258*b* of the housing 250 and locking recess 162*a* and 162*b*, respectively, of the nozzle assemblies 160*a* and 160*b*, thereby securing the nozzle assemblies 160*a* and 160*b* within the nozzle apertures 256*a* and 256*b* of the housing 250. Other securement techniques are also possible. In this manner, the drilling fluids 40 in the central bore 252 of the housing 250 pass through branched conduits 254*a*, 254*b* to the nozzle assemblies 160*a*, 160*b*, and the nozzle assemblies 160*a*, 160*b* direct the drilling fluids 40 from the branched conduits 254*a*, 254*b* in the housing 250 against the bottom surface 22 of the well bore 20.

Referring back to FIG. 3, the housing 150 can also be modified to form the housing 250. In formations that do not require a bowl nozzle 160*c*, a plug 160*d* can be inserted and secured into the bowl nozzle aperture 156*c* of the housing 150 in place of the bowl nozzle 160*c* leaving only the formation nozzles 160*a* and 160*b*, thereby functioning in the same manner as the housing 250. Therefore, the housing 150 can be used either as the housing 150 with the bowl nozzle 160*c*, or as the housing 250 without the bowl nozzle 160*c*, and the selection can be made at the well head without replacing the bit 10 having a housing 150 with a bit 10 having a housing 250.

Similar to the nozzle assemblies 160*a* and 160*b* in the housing 150, the nozzle assemblies 160*a* and 160*b* in the drill bit 10 are dual discharge nozzles that discharge against the adjacent formation 22 with a dual discharge output 170 having a swirling vortex flow 171, with a generally cone-shaped profile, and an axial flow 173. The high speed swirling flow creates a low pressure region 172 in the center of the discharged vortex flow 171. The low pressure region 172 in the center of the swirling vortex 171 facilitates the discharge of the axial jet stream 173 therethrough. In a preferred embodiment, the nozzle assemblies 160*a* and 160*b* in the drill bit 10 are mounted within about ½ a nozzle diameter to about 10 nozzle diameters of the adjacent formation 22, depending upon the application.

Figure 5:
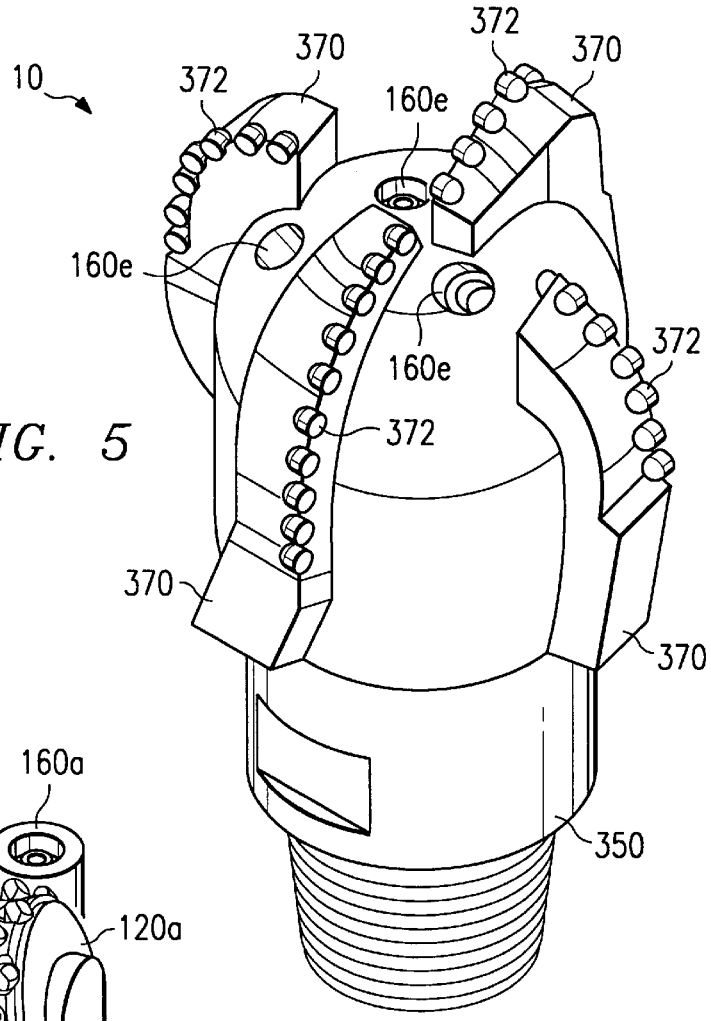
FIG. 5 is an enlarged perspective view of another embodiment of the drill bit in FIG. 1, illustrating the construction thereof in accordance with the principles of the present invention.

Another embodiment of the drill bit 10 from FIG. 1 is illustrated in FIG. 5. The drill bit 10, as shown in FIG. 5, generally comprises a housing 350 having a plurality of fixed cutters 370 thereon, and a plurality of nozzle assemblies 160*e*. The fixed cutters 370 each have a plurality of cutter teeth 372 thereon. In the drill bit 10 of FIG. 5, the cutter teeth 372 engage the bottom surface 22 of the well bore 20. The dual jet assemblies 160*e* aid in the removal of material from the bottom surface 22 of the well bore 20. Although the drill bit 10 is illustrated in FIG. 5 as having four fixed cutters 370 and a specified number of dual jet assemblies, it is contemplated that the present invention also includes any number of fixed cutters, any number of dual jet nozzle assemblies, or any combination thereof.

In accordance with the principles of the present invention, conventional nozzles can be used in combination with at least one of the dual jet nozzle assemblies. For example, conventional nozzles having simple axial or vortex flow can be used in the bowl nozzle aperture 156*c* in place of the dual jet nozzle 160*c*. As another example, conventional nozzles having simple axial or vortex flow can be used in place of at least one of the dual jet nozzles 160*a* and 160*b*. As yet another example, conventional nozzles having simple axial or vortex flow can be used in place of at least one of the dual jet nozzles 160*e*. Also in accordance with the present invention, the nozzles 160*a*, 160*b*, 160*c*, 160*e*, or the conventional nozzles used in place of any of those nozzles, can have different selected flow rates. Furthermore, any one of the nozzles 160*a*, 160*b*, 160*c*, or 160*e* can be replaced by a plug that prevents flow, such as the plug 160*d*.

Figure 6:
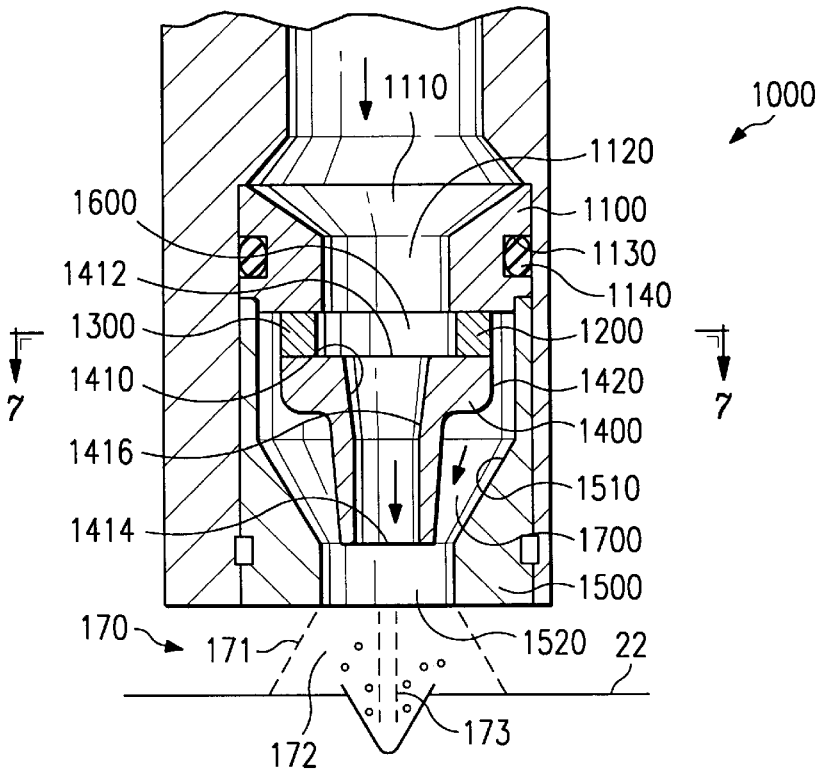
FIG. 6 is a side-elevational cross-sectional view of one embodiment of the dual jet nozzle from FIGS. 1–5, constructed in accordance with the principles of the present invention.
Figure 7:
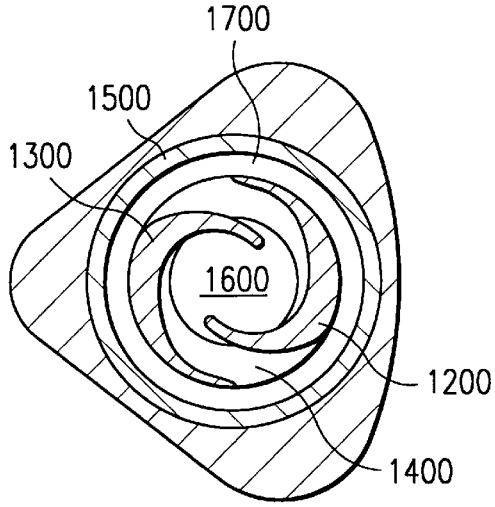
FIG. 7 is a cross-sectional view of the dual jet nozzle of FIG. 6, taken across lines 7—7 thereof.

One embodiment of the dual jet nozzle assemblies 160*a*, 160*b*, 160*c*, and 160*e* in FIGS. 3, 4, and 5, is illustrated as a nozzle assembly 1000 in FIGS. 6 and 7. The nozzle 1000 of this particular embodiment comprises a series of steel and/or tungsten carbide elements having a central bore formed therethrough. The nozzle assembly 1000 generally comprises a nozzle bulkhead 1100, vanes 1200 and 1300, a flow divider 1400, and a nozzle head 1500. The nozzle bulkhead 1100 is provided as a base upon which the vanes 1200 and 1300 are brazed, bonded or the like. The flow divider 1400 is likewise secured to the vanes 1200 and 1300 to form a single assembly of elements 1100, 1200, 1300 and 1400 that is bonded or brazed to the nozzle head 1500. The cylindrical nozzle bulkhead 1100 is also constructed with an O-ring groove 1130 and an O-ring 1140 is placed in there for sealed engagement with the nozzle aperture in the housing.

The nozzle bulkhead 1100 of the nozzle 1000 includes a tapered mouth 1110 leading to a flow section 1120. The vanes 1200 and 1300 are partially positioned over the flow section 1120 of the nozzle bulkhead 1100. In this particular embodiment, the vanes 1200 and 1300 are also positioned within the generally infundibular bore shape of inside walls 1510 of the nozzle head 1500. A central aperture 1410 of the flow divider 1400 has a divider 1400 inlet 1412 that is smaller than the flow section 1120 in the nozzle bulkhead 1100, and is positioned downstream of the flow section 1120. The divider inlet 1412 of the central aperture 1410 is connected to a divider exit orifice 1414 by a tapered region 1416. The flow divider 1400 also has bell-shaped outer walls 1420. Inside walls 1510 of the nozzle head 1500 are formed with a taper which complements the bell-shaped outer walls 1420 of the flow divider 1400 and terminates in a generally cylindrical discharge orifice 1520. A vortex annulus 1700 is formed between the bell-shaped outer walls 1420 of the flow divider 1400 and the inside walls 1510 of the nozzle head 1500.

In operation, a liquid flows under pressure into the tapered mouth 1110 of the nozzle bulkhead 1100. A flow transition region 1600 is formed downstream of the flow region 1120 of the nozzle bulkhead 1100 by the vanes 1200 and 1300 and the flow divider 1400. The liquid passes from the tapered mouth 1110 of the nozzle bulkhead 1100 through the flow section 1120 into the flow transition region 1600. Some of the liquid then flows through the center of the transition region 1600 into the divider inlet 1412 of the flow divider 1400. Fluids entering the divider inlet 1412 of the flow divider 1400 pass through the tapered region 1416 of the central aperture 1410 and exit through the divider exit orifice 1414 as an axial flow.

The pressurized liquid flowing through the nozzle bulkhead 1100 is forced into flow transition region 1600 where the flow is forced between vanes 1200 and 1300 and into flow divider inlet 1412, thereby inducing some of flow to spiral outwardly into the vortex annulus 1700. An outwardly directed flow emerges from the flow transition region 1600 into the vortex annulus 1700 and swirls therein while passing axially in the direction of the discharge orifice 1520. As the swirling flow propagates axially about the vortex annulus 1700, a swirling vortex is created in conjunction therethrough. By virtue of the law of conservation of angular momentum, the speed of the swirling flow increases as it passes into the narrower section of the vortex annulus 1700 where the diameter of the swirling flow is reduced. At the discharge orifice 1520, the swirling vortex flow from the vortex annulus 1700 meets the axial flow from the divider exit orifice 1414 of the flow divider 1400, where both are discharged as separate streams from the dual discharge nozzle 1000.

The dual discharge nozzle 1000 discharges with the dual discharge output 170 having a swirling vortex flow 171, with a generally cone-shaped profile, and an axial flow 173. The high speed swirling flow from the vortex annulus 1700, as described above, creates the low pressure region 172 in the center of the discharged vortex flow 171. The low pressure region 172 in the center of the swirling vortex 171 facilitates the discharge of the axial jet stream 173 therethrough since said axial jet stream discharge will not need to overcome the ambient fluid pressure therearound.

Figure 8:
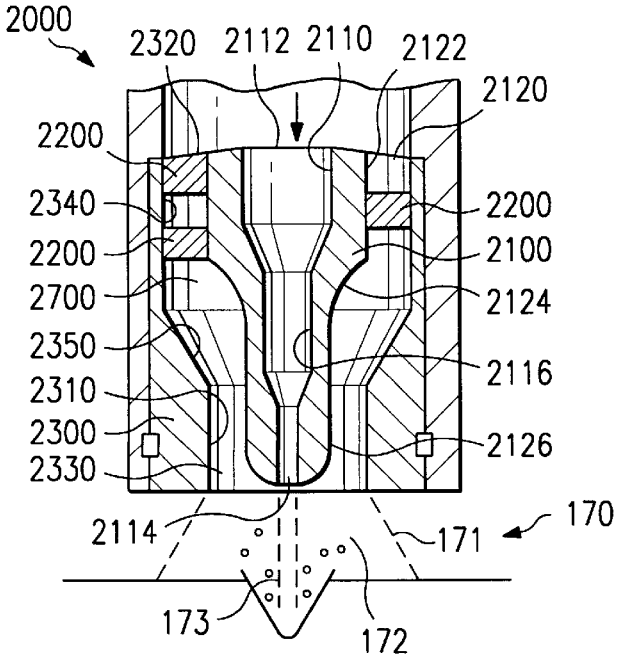
FIG. 8 is a side-elevational cross-sectional view of another embodiment of the dual jet nozzle from FIGS. 1–5, constructed in accordance with the principles of the present invention.

Another embodiment of the dual jet nozzle assemblies 160*a,* 160*b,* and 160*c* in FIGS. 3 and 4, is illustrated as a nozzle assembly 2000 in FIG. 8. The nozzle 2000 of this particular embodiment also comprises a series of steel and/or tungsten carbide elements having a central bore therethrough. The nozzle assembly 2000 generally comprises a central body 2100, a helical vane 2200 formed around the central body 2100, and a nozzle head 2300 enclosing the central body 2100 and the helical vane 2200. The helical vane 2200 is typically machined as an integral part of the central body 2100. The central body 2100 with its integral vane 2200 is brazed, bonded or the like to nozzle head 2300, thereby forming a single assembly of the elements 2100, 2200, and 2300.

A central bore 2110 of the central body 2100 has an central body inlet 2112 connected to a central body exit orifice 2114 by a tapered passage 2116. The exterior 2120 of the central body 2100 has a tapered outer transition region 2124 that tapers into an elongate discharge body section 2126. The nozzle head 2300 has a central aperture 2310 with a nozzle inlet 2320 connected to a nozzle discharge orifice 2330 by tapered inner walls 2350 and vane mounting region 2340. The laterally extending vane 2200 spirals downwardly between the region 2122 of the central body 2100 and the vane mounting region 2340 of the nozzle head 2300. A vortex annulus 2700 is formed between the exterior 2120 of the central body 2100 and the exterior walls 2320 of the nozzle head 2300.

In operation, a fluid flows under pressure to the nozzle inlet 2320 of the nozzle head 2300. A portion of the fluid reaching the nozzle inlet 2320 enters the central body inlet 2112 of the central bore 2110 of the central body 2100. Fluids entering the central body inlet 2112 pass through the tapered passage 2116 in the central bore 2110 and exit the central body 2100 through the central body exit orifice 2114 as an axial flow. Another portion of the fluid reaching the nozzle inlet 2320 enters the area between the central body 2100 and the nozzle head 2300, and engages the helical vane 2200. Fluids passing over the helical vane 2200 swirl as they pass into the vortex annulus 2700. As the swirling flow propagates axially about the vortex annulus 2700, a swirling vortex is created in conjunction therethrough. Similar to the nozzle assembly 1000, by virtue of the law of conservation of angular momentum, the speed of the swirling flow increases as it passes into the narrower section of the vortex annulus 2700 where the diameter of the swirling flow is reduced. At the discharge orifice 2330, the swirling vortex flow from the vortex annulus 2700 meets the axial flow from the central body exit orifice 2114, where both are discharged as separate streams from the dual discharge nozzle 2000.

Similar to the dual discharge nozzle 1000, the dual discharge nozzle 2000 discharges with the dual discharge output 170 having the swirling vortex flow 171, with a generally cone-shaped profile, and the axial flow 173. The high speed swirling flow from the vortex annulus 2700, as described above, creates the low pressure region 172 in the center of the discharged vortex flow 171. The low pressure region 172 in the center of the swirling vortex 171 facilitates the discharge of the axial jet stream 173 therethrough.

Figure 9:
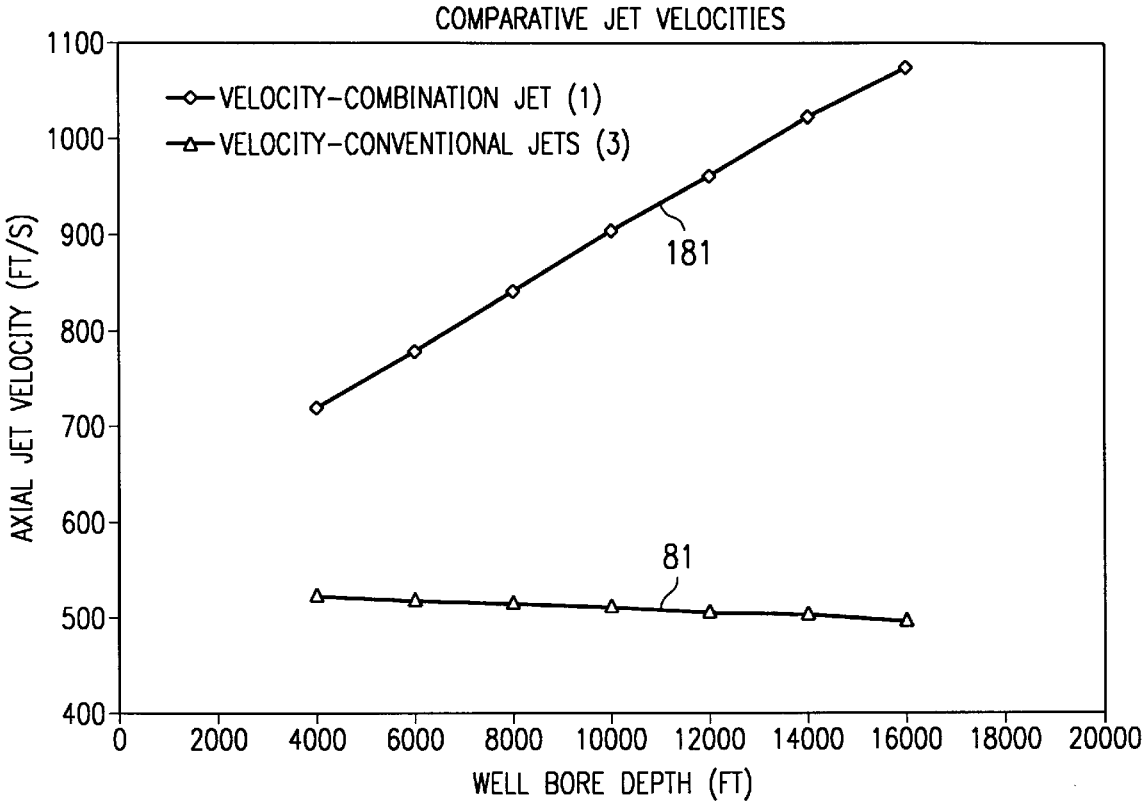
FIG. 9 is a chart illustrating one aspect of the performance of the dual jet nozzle of the present invention relative to a prior art nozzle by comparing the axial jet velocities of each.

Referring now to FIG. 9, there is shown a chart representing comparative drill bit jet velocities between a conventional axial nozzle, represented by curve 81 and the dual discharge nozzle of the present invention represented by curve 181. The data comprising the charts of FIGS. 9 and 10, which was established in part from flow test data and in part from extrapolation derived from computer modeling, represents the expected relationships involved in the flow form of the nozzles 1000 and 2000. Along the Y axis, the axial jet velocity in feet per second is presented while the depth of the bore hole is presented along the X axis. As discussed above, the deeper the borehole, the higher the hydrostatic pressure at the bottom thereof becomes in the area of the drill bit. Conditions are set with a 2,500 PSI surface pressure for a five inch drill pipe and 10 lbs. per gallon drilling mud. The velocity appearing along line 81 for three (3) conventional axial nozzles of 9/32" diameter is shown to decrease between the depth of 4,000 feet and 16,000 feet. Across these same depths, the combination jet of the present invention is measured with a 2" diameter inlet and a 1¼" exit orifice for the vortex and a 0.375 axial jet ID (2"/1.25"/0.375" combination jet). The discharge velocity increases from 700 feet per second at a 4,000 ft. depth, to over 1,000 feet per second at a 16,000 ft. depth. It may thus be seen that the velocity of the axial jet has the potential to increase to over twice the velocity of a conventional jet due to the combined effectiveness of the vortex depressurization described above.

Figure 10:
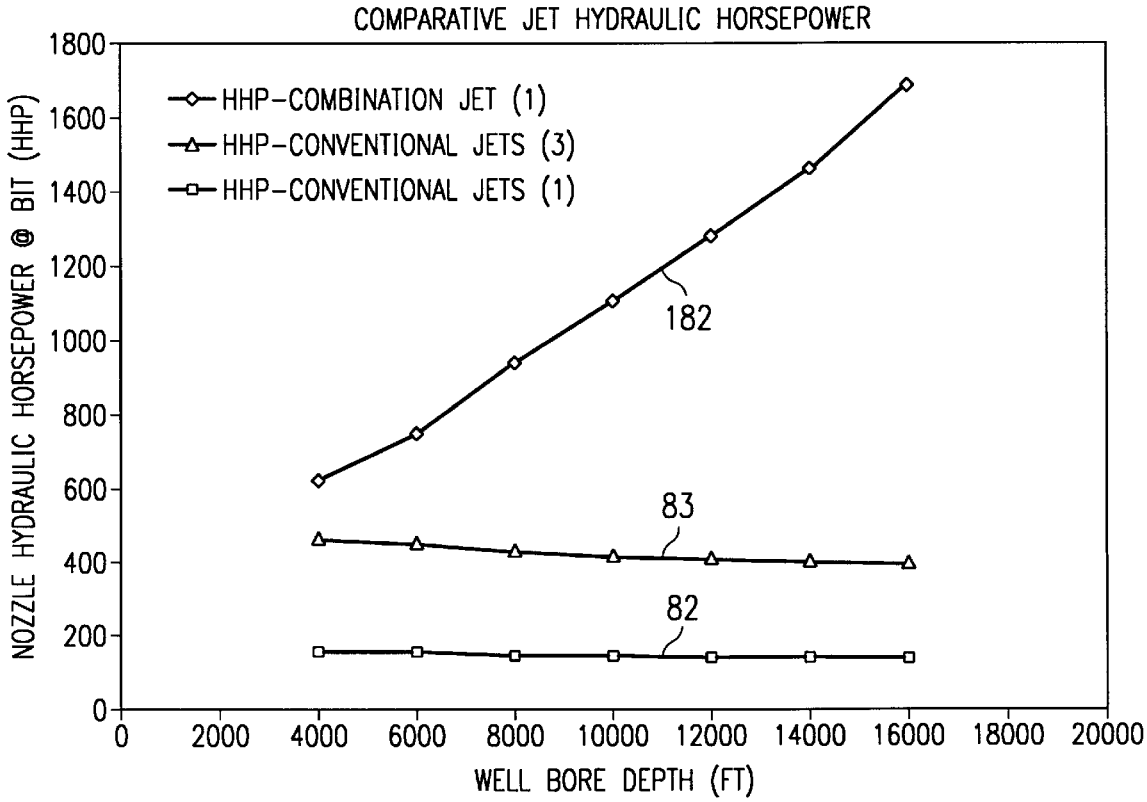
FIG. 10 is a chart illustrating the comparison between the prior art nozzle and the dual jet nozzle constructed in accordance with the principles of the present invention comparing the hydraulic horsepower thereof.

Referring now to FIG. 10, there is shown a similar chart comparing hydraulic horsepower at the drill bit between conventional axial nozzles and the above-described 2"/1.25"/0.375" combination jet nozzle of the present invention for depths between 4,000 and 16,000 feet. The hydraulic horsepower available in a single 9/32" axial nozzle is represented by a line 82 while the hydraulic horsepower available to three 9/32" axial nozzles of conventional design is represented by line 83.

It may be seen that both lines are substantially horizontal. The hydraulic horsepower available to be generated from the nozzle of the present invention across the same depth range is shown in line 182. It may be seen that the hydraulic horsepower available with the present invention has the potential to increase from 600 HP at 4,000 feet to over 1,600 HP at 16,000 feet. This chart thus quantifies and qualifies the potential extent of the hydraulic horsepower available which is generated by the nozzle of the present invention, as compared to conventional jet nozzle designs.

As the drill bit 10 is rotated against the bottom surface 22 by the drill string 30, the teeth 124*a,* 124*b,* 128*a,* 128*b* act upon the bottom surface 22. When the formation of the bottom surface 22 is shale, the formation removed from the bottom surface 22 will tend to collect on the rows of cutters 122*a,* 122*b,* 126*a,* and 126*b* of the roller cones 120*a* and 120*b*. The bit balling formed by the reconstitution of formation on the roller cones 120*a* and 120*b,* limit the extent to which the roller cone teeth 124*a,* 124*b,* 128*a,* and 128*b* can penetrate the bottom surface 22 of the well bore 20. However, the axial flow 173 from the bowl nozzle 160*c* engages the formation built up on the cones 120*a* and 120*b,* and removes that formation so that the teeth 124*a,* 124*b,* 128*a,* and 128*b* can penetrate the bottom surface 22 of the well bore 20 with full penetration.

Also when the formation of the bottom surface 22 is shale, the formation removed from the bottom surface 22 of the well bore 20 tends to reconstitute onto the bottom surface 22 after being removed by the drill bit 10. The reconstitution of formation on the bottom surface 22 is called bottom balling, and limits the penetration of the teeth on the drill bit 10 into the virgin formation of the bottom surface 22. However, the high rotational speed of the swirling vortex flow 171 from the formation drill jet nozzles 160*a* and 160*b,* or 160*e,* of the present invention, and the additional hydraulic horsepower in the axial jet stream 173 from the formation drill jet nozzles 160*a* and 160*b,* or 160*e,* of the present invention, will remove the reconstituted formation on the bottom surface 22 of the well bore 20, and thereby allow the teeth of the drill bit 10 to penetrate virgin formation.

When formation of the bottom surface 22 is hard rock, the action by the teeth of the drill bit 10 is to densify an area of the formation under the teeth to effect a crack in the bottom surface 22. When the porosity is collapsed, or densified, in the formation below a tooth, nozzles in the conventional drill bits do not have enough hydraulic energy to remove the crushed material below the tooth indentation when the tooth is removed. As a result, a cushion or densification pad of densified material is left on the bottom surface by the prior art drill bits that will spread the force of the prior art drill bit tooth indent a larger area and reduce the effectiveness of the conventional prior art drill bit when the tooth rolls into the previously made tooth indentation. However, the high rotational speed of the swirling vortex flow 171 from the dual jet nozzles 160*a* and 160*b,* or 160*e,* of the present invention, and the additional hydraulic horsepower in the axial jet stream 173 from the dual jet nozzles 160*a* and 160*b,* or 160*e* of the present invention, will help remove the densified pad within the indentured pockets created by the teeth of the drill bit 10 and allow the teeth of the drill bit 10 to contact virgin formation.

Figure 11:
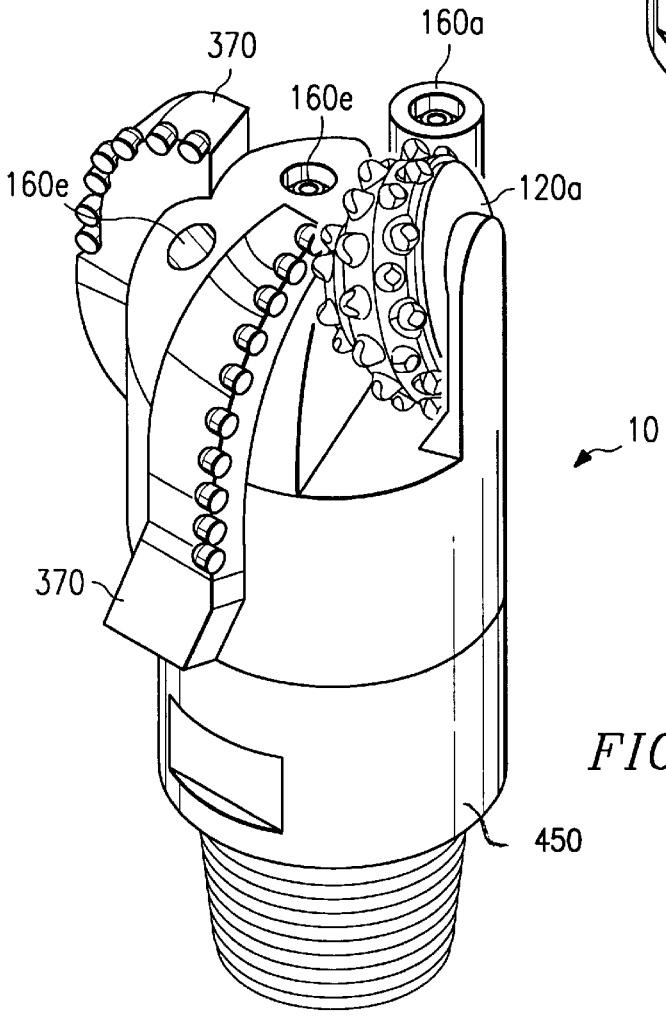
FIG. 11 is a perspective view of another embodiment of the drill bit in FIG. 1, illustrating the construction thereof in accordance with the principles of the present invention.

Another embodiment of the drill bit 10 from FIG. 1 is illustrated in FIG. 11. The drill bit 10, as shown in FIG. 11, generally comprises a housing 450 having a fixed cutter 370 thereon, a roller cone 120 rotatable attached thereto, and nozzle assemblies 160*a* and 160*e*. In the drill bit 10 of FIG. 11, the fixed cutter 370 and roller cone 120 engage the bottom surface 22 of the well bore 20. The dual jet assemblies 160*a* and 160*e* aid in the removal of material from the bottom surface 22 of the well bore 20.

It is thus believed that the operation and construction of the present invention will be apparent from the foregoing description. While the method and apparatus shown and described has been characterized as being preferred, it will be obvious that various changes and modifications may be made therein without due parting from the spirit and scope of the invention as defined in the following claims.

What is claimed is:

1. A method of drilling a surface with a drill bit utilizing a high velocity liquid jet, said method comprising the steps of:

providing a drill bit with a drill bit housing having at least one bore formed therein;

forming a dual-discharge nozzle for generating a first, swirling liquid jet and at least one second, axial liquid jet in combination therewith;

securing said nozzle in said housing in flow communication with said bore;

injecting liquid into said bore and into said nozzle and generating said first swirling liquid jet and a said second, axial liquid jet therewith;

discharging said liquid jets from said nozzle and against said surface;

constructing said drill bit housing for mechanical cutting of said surface; and providing said drill bit housing with at least one roller cone and securing said nozzle adjacent said roller cone for use in conjunction therewith for the erosion of said surface.

2. The method as set forth in claim 1 and further including the steps of forming a vortex flow nozzle for spraying the roller cone and injecting fluid into the vortex flow nozzle so that a vortex fluid flow from said vortex flow nozzle contacts said roller cone.

3. The method as set forth in claim 2 wherein said step of forming a vortex flow nozzle includes forming a vortex flow nozzle for spraying a swirling liquid vortex flow in the opposite direction of the rotational direction of said roller cone.

4. The method as step forth in claim 2, wherein said step of forming the vortex flow nozzle includes providing a vortex swirl inducer.

5. The method as set forth in claim 4, further including the step of forming said vortex swirl inducer with at least one lateral flow vane for the propagation of liquid in a swirling direction.

6. The method as set forth in claim 2 wherein said step of forming a vortex flow nozzle includes placing said vortex flow nozzle in a bowl of said housing.

7. The method as set forth in claim 2 wherein said step of forming a vortex flow nozzle includes forming said vortex flow nozzle as a dual flow nozzle having a vortex flow stream and an axial flow stream.

8. A method of drilling a surface with a drill bit utilizing a high velocity liquid jet, said method comprising the steps of:

providing a drill bit with a drill bit housing having at least one bore formed therein;

forming a dual-discharge nozzle for generating a first, swirling liquid jet and at least one second, axial liquid jet in combination therewith;

securing said nozzle in said housing in flow communication with said bore;

injecting liquid into said bore and into said nozzle and generating said first swirling liquid jet and a said second, axial liquid jet therewith;

discharging said liquid jets from said nozzle and against said surface;

constructing said drill bit housing with at least one roller cone and providing said drill bit housing with at least one fixed cutter; and securing said nozzle adjacent said fixed cutter for use in conjunction therewith for the erosion of said surface.

9. A method of drilling a surface with a drill bit utilizing a high velocity liquid jet, said method comprising the steps of:

providing a drill bit with a drill bit housing having at least one bore formed therein;

forming a dual-discharge nozzle for generating a first, swirling liquid jet and at least one second, axial liquid jet in combination therewith;

securing said nozzle in said housing in flow communication with said bore;

injecting liquid into said bore and into said nozzle and generating said first swirling liquid jet and a said second, axial liquid jet therewith;

discharging said liquid jets from said nozzle and against said surface;

providing a liquid swirl inducer within said nozzle and wherein said step of generating said first swirling liquid jet includes the step of passing liquid across said liquid swirl inducer;

forming said liquid swirl inducer with a central aperture for generating said second, axial jet therein in conjunction with said first swirling jet; and forming said liquid swirl inducer with internal flow vanes disposed about said central aperture for generating a swirling liquid flow propagating about said axial flow extending therethrough.

10. The method as set forth in claim 9 and further including the step of forming said internal vanes with a plurality of curvilinear elements disposed in a swirl cavity concentrically aligned with said axial flow aperture.

11. A method of drilling a surface with a drill bit utilizing a high velocity liquid jet, said method comprising the steps of:

providing a drill bit with a drill bit housing having at least one bore formed therein;

forming a dual-discharge nozzle for generating a first, swirling liquid jet and at least one second, axial liquid jet in combination therewith;

securing said nozzle in said housing in flow communication with said bore;

injecting liquid into said bore and into said nozzle and generating said first swirling liquid jet and a said second, axial liquid jet therewith;

discharging said liquid jets from said nozzle and against said surface;

mounting said nozzle in a position recessed from the end of said bit;

forming said nozzle with a single discharge orifice for said first and second jets; and recessing said nozzle orifice from the end of said bit a distance on the order of one-half of the diameter of said orifice.

12. The method as set forth in claim 11 wherein said step of forming said nozzle includes the step of constructing said nozzle with a diameter on the order of one inch.

13. A method of drilling a surface with a drill bit utilizing a high velocity liquid jet, said method comprising the steps of:

providing a drill bit with a drill bit housing having at least one bore formed therein;

forming a dual-discharge nozzle for generating a first, swirling liquid jet and at least one second, axial liquid jet in combination therewith;

securing said nozzle in said housing in flow communication with said bore;

injecting liquid into said bore and into said nozzle and generating said first swirling liquid jet and a said second, axial liquid jet therewith;

discharging said liquid jets from said nozzle and against said surface;

mounting said nozzle in a position recessed from the end of said bit; and constructing said bit with at least first and second opposed roller cones adapted for mechanical cutting of said surface.

14. The method as set forth in claim 13 and further including the step of providing two nozzles oppositely disposed about said two roller cones.

15. A method of drilling a surface with a drill bit utilizing a high velocity liquid jet, said method comprising the steps of:

providing a drill bit with a drill bit housing having at least one bore formed therein;

forming a dual-discharge nozzle for generating a first, swirling liquid jet and at least one second, axial liquid jet in combination therewith;

securing said nozzle in said housing in flow communication with said bore;

injecting liquid into said bore and into said nozzle and generating said first swirling liquid jet and a said second, axial liquid jet therewith;

discharging said liquid jets from said nozzle and against said surface;

mounting said nozzle in a position recessed from the end of said bit; and providing said bit with a plurality of nozzles and a plurality of roller cones and positioning at least one of said nozzles between said roller cones.

16. An apparatus comprising:

a housing adapted for movement relative to a surface;

means associated with said housing for the flow of liquid therethrough;

at least one dual discharge liquid jet nozzle disposed in said housing and positioned in flow communication with said liquid flow means for the discharge of a first, swirling liquid jet and a second, axial jet in combination therewith;

means for moving said housing relative to said surface; and said housing comprises a drill bit having at least one roller cone.

17. An apparatus comprising:

a housing adapted for movement relative to a surface;

means associated with said housing for the flow of liquid therethrough;

at least one dual discharge liquid jet nozzle disposed in said housing and positioned in flow communication with said liquid flow means for the discharge of a first, swirling liquid jet and a second, axial jet in combination therewith;

means for moving said housing relative to said surface;

a liquid swirl inducer secured within said nozzle for forming said first swirling jet;

said liquid swirl inducer includes a central aperture formed therethrough for generating said second, axial jet therein in conjunction with said first swirling jet; and said swirl inducer is formed with internal flow vanes disposed about said central aperture for generating a swirling liquid flow propagating about said axial flow extending therethrough.

18. The apparatus as set forth in claim 17 wherein said internal flow vane is formed by a plurality of curved elements disposed in a swirl cavity concentrically aligned with said axial flow aperture.

19. An apparatus comprising:

a housing adapted for movement relative to a surface;

means associated with said housing for the flow of liquid therethrough;

at least one dual discharge liquid jet nozzle disposed in said housing and positioned in flow communication with said liquid flow means for the discharge of a first, swirling liquid jet and a second, axial jet in combination therewith;

means for moving said housing relative to said surface;

said nozzle is mounted in said housing in a position recessed from the end thereof; and said nozzle is formed with a discharge orifice and is recessed from the end of said housing a distance on the order of one-half of the diameter of said orifice.

20. The apparatus as set forth in claim 19 wherein said housing comprises a bore hole drill bit and said nozzle is constructed with a diameter on the order of one inch.

21. The apparatus as set forth in claim 20 wherein said drill bit is constructed with first and second opposed roller cones adapted for mechanical cutting of said surface.

22. The apparatus as set forth in claim 21 and further including two nozzles oppositely disposed about said roller cones secured in said bit.

23. An apparatus comprising:

a liquid jet nozzle adapted for the discharge of jet streams therefrom;

means associated with said nozzle for forming a localized depressurized fluid region adjacent said nozzle and discharging an axial jet stream therethrough; and means for directing said depressurized fluid region and jet stream discharged by said nozzle toward a surface.

24. The apparatus as set forth in claim 23 wherein said means for forming said localized depressurized region comprises a liquid swirl inducer secured within said nozzle for forming a first swirling liquid jet.

25. The apparatus as set forth in claim 24 wherein said liquid swirl inducer is formed with a central aperture therethrough for generating said axial jet therein in conjunction with said first swirling jet.

26. The apparatus as set forth in claim 25 wherein said swirl inducer is formed with internal flow vanes disposed about said central aperture for generating a swirling liquid flow propagating about said axial flow extending therethrough.

27. An apparatus comprising:

a housing adapted for movement relative to said surface and having a nozzle mounted therewith;

means associated with said nozzle for forming a swirling liquid jet discharging a vortex jet stream;

means associated with said nozzle for forming an axial jet stream passing through said vortex jet stream;

at least one liquid jet nozzle secured to said housing and positioned for the discharge of said dual jet streams therefrom;

said swirling jet means includes a generally cylindrical chamber disposed within said nozzle and a liquid flow passage disposed in flow communication therewith for the axial injection of fluid into said chamber and the generation of a swirling flow therein; and said swirling jet means further includes a vane structure secured within said cylindrical chamber for inducing said liquid to swirl therein.

28. The apparatus as set forth in claim 27 wherein said vane structure includes a plurality of axially upright, curved vane elements adapted to engage the flow of liquid and impart angular flow thereto.

29. The apparatus as set forth in claim 27 wherein said vane structure comprises at least one laterally extending spiral member formed about a central body disposed within said cylindrical chamber.

30. The apparatus as set forth in claim 29 wherein said central body is formed with an axial bore therethrough comprising said axial jet stream means adapted for passing said axial jet stream therethrough intermediate of said vortex jet stream formed therearound.

31. An apparatus comprising:

a housing adapted for movement relative to a surface and having a nozzle mounted therewith;

means associated with said nozzle for forming a swirling liquid jet discharging a vortex jet stream;

means associated with said nozzle for forming an axial jet stream passing through said vortex jet stream;

at least one liquid jet nozzle secured to said housing and positioned for the discharge of said dual jet streams therefrom;

said housing comprises a drill bit for the drilling of a bore hole; and said drill bit is of the type having roller cones formed thereon for the mechanical engagement of said surface and the penetration thereof.

32. The apparatus as set forth in claim 31 wherein said nozzle is disposed in said drill bit at a position recessed from the ends of said roller cones a sufficient distance for permitting the generation of a vortex jet stream against said surface and the passage of said axial jet stream therein to engagement with said surface.

33. An apparatus comprising:

a liquid jet nozzle adapted for the discharge of dual jet streams therefrom;

means associated with said nozzle for forming a swirling liquid jet and an axial jet stream passing therethrough;

means for causing said swirling liquid jet and said axial jet stream to meet before exiting said liquid jet nozzle; and means for directing said dual jet streams discharged by said nozzle toward a surface.

34. The apparatus as set forth in claim 33 wherein said directing means comprises a drill bit for the drilling of a bore hole into an earth formation.

35. The apparatus as set forth in claim 34 wherein said drill bit is of the type having fixed cutters formed thereon for the mechanical engagement of said surface and the penetration thereof.

36. The apparatus as set forth in claim 35 wherein said nozzle is disposed in said drill bit in a position recessed from the ends of said fixed cutters a sufficient distance for permitting the generation of a vortex jet stream against said surface and the passage of said axial jet stream therein into engagement into said surface.

37. An apparatus comprising:

a liquid jet nozzle adapted for the discharge of dual jet streams therefrom;

means associated with said nozzle for forming a swirling liquid jet and an axial jet stream passing therethrough;

means for directing said dual jet streams discharged by said nozzle toward a surface;

wherein said swirling jet means includes a generally cylindrical chamber disposed within said nozzle and a liquid flow passage disposed in flow communication therewith for the injection of fluid into said chamber and the generation of a swirling flow therein; and wherein said axial jet means includes a central bore formed in said nozzle facilitating the axial flow of liquid therethrough and through said vortex stream.

38. An apparatus comprising:

a liquid jet nozzle adapted for the discharge of dual jet streams therefrom;

means associated with said nozzle for forming a swirling liquid jet and an axial jet stream passing therethrough;

means for directing said dual jet streams discharged by said nozzle toward a surface;

wherein said swirling jet means includes a generally cylindrical chamber disposed within said nozzle and a liquid flow passage disposed in flow communication therewith for the injection of fluid into said chamber and the generation of a swirling flow therein; and wherein said swirling jet means further includes a vane structure secured within said cylindrical chamber for inducing said liquid to swirl therein.

39. The apparatus as set forth in claim 38 wherein said vane structure includes at least one axially upright, curved vane element adapted to engage the flow of liquid and impart angular flow thereto.

40. The apparatus as set forth in claim 38 wherein said vane structure comprises at least one laterally extending spiral member formed about a central body disposed within said cylindrical chamber.

41. The apparatus as set forth in claim 40 wherein said central body is formed with an axial bore therethrough comprising said axial jet stream means adapted for passing said axial jet stream therethrough intermediate of said vortex jet stream formed there around.

42. An apparatus comprising:

a liquid jet nozzle adapted for the discharge of dual jet streams therefrom;

means associated with said nozzle for forming a swirling liquid jet and an axial jet stream passing therethrough;

means for directing said dual jet streams discharged by said nozzle toward a surface;

wherein said directing means comprises a drill bit for the drilling of a bore hole into an earth formation; and wherein said drill bit is of the type having roller cones formed thereon for the mechanical engagement of said surface and the penetration thereof.

43. The apparatus as set forth in claim 42 wherein said nozzle is disposed in said drill bit in a position recessed from the ends of said roller cones a sufficient distance for permitting the generation of a vortex jet stream against said surface and the passage of said axial jet stream therein into engagement into said surface.

44. A method of drilling a surface utilizing a fluid jet stream, comprising the steps of:

providing a fluid jet nozzle adapted for the discharge of at least one jet stream therefrom;

forming means associated with said nozzle for creating a localized depressurized fluid region adjacent said nozzle during discharge of at least one jet stream;

passing fluid through said nozzle to form said depressurized fluid region;

discharging an axial jet stream from said nozzle through said depressurized fluid region; and directing said depressurized fluid region and said axial jet stream toward a surface.

45. The method as set forth in claim 44 and further including the steps of constructing said nozzle in a drill bit housing for mechanical cutting of said surface and providing said drill bit housing with at least one roller cone and securing said nozzle adjacent said roller cone for use in conjunction therewith for the erosion of said surface.

46. The method as set forth in claim 44 and further including the steps of constructing said nozzle in a drill bit housing for mechanical cutting of said surface and providing said drill bit housing with at least one fixed cutter and securing said nozzle adjacent said fixed cutter for use in conjunction therewith for the erosion of said surface.

47. The method as set forth in claim 44 wherein said step of forming means for creating said depressurized region comprises the step of providing a fluid swirl inducer and securing said swirl inducer within said nozzle and wherein said step of passing fluid through said nozzle includes the step of passing fluid across said fluid inducer.

48. The method as set forth in claim 47 and further including the step of forming said fluid swirl inducer with a central aperture for generating said axial jet therein in conjunction with said first swirling jet.

49. The method as set forth in claim 48 and further including the step of forming said fluid swirl inducer with lateral flow vanes there around for the propagation of liquid in a swirling direction in association therewith.

50. The method as set forth in claim 48 and further including the step of forming said fluid swirl inducer with internal flow vanes disposed about said central aperture for generating a swirling fluid flow propagating about said axial flow extending therethrough.

51. The method as set forth in claim 50 and further including the step of forming said internal vanes with a plurality of curvilinear elements disposed in a swirl cavity concentrically aligned with said axial flow aperture.

52. An apparatus comprising a drill bit having a housing and at least one roller cone adapted for movement relative to a surface;

means associated with said housing for the flow of liquid therethrough; and a dual discharge liquid jet nozzle disposed in said housing and positioned in flow communications with said liquid flow means for discharge of a first, swirling liquid jet and a second, axial jet in combination therewith, said first, swirling liquid jet and said second, axial liquid jet being directed toward at least one roller cone of said drill bit.

53. The apparatus as set forth in claim 52, wherein said first, swirling liquid jet is coaxially aligned with said second, axial liquid jet.

54. The apparatus as set forth in claim 52 and further including a liquid swirl inducer secured within said nozzle for forming said first swirling jet.

55. The apparatus as set forth in claim 54 wherein said liquid swirl inducer includes a central aperture formed therethrough for generating said second, axial jet therein in conjunction with said first swirling jet.

56. The apparatus as set forth in claim 55 wherein said swirl inducer is formed with lateral flow vanes there around for the propagation of liquid in a swirling direction in association therewith.

57. The apparatus as set forth in claim 55 wherein said swirl inducer is formed with internal flow vanes disposed about said central aperture for generating a swirling liquid flow propagating about said axial flow extending therethrough.

58. The apparatus as set forth in claim 52 wherein said internal flow vanes are formed by a plurality of curved elements disposed in a swirl cavity concentrically aligned with said axial flow aperture.

59. The apparatus as set forth in claim 52 further including a second dual discharge liquid jet nozzle being directed toward said surface.

60. A fluid nozzle for use in a drill bit, said nozzle comprising:

a nozzle housing have a central bore therethrough with a nozzle inlet and an exit orifice, said central bore for the passage of fluid through said nozzle housing;

means for generating a low pressure region adjacent to said exit nozzle;

means for discharging a portion of fluid passing through said central bore as an axial stream passing through the low pressure region generated by said means for generating a low pressure region.

61. The nozzle as set forth in claim 60, wherein said means for generating a low pressure region comprises a swirl inducer for forming a swirling fluid stream.

62. The nozzle as set forth in claim 60, wherein said means for discharging an axial stream comprises a flow divider having a central aperture therethrough.

63. The nozzle as set forth in claim 62, wherein said means for forming a low pressure region comprises a swirl inducer for discharging a swirling liquid stream.

64. The nozzle as set forth in claim 63, wherein said swirl inducer includes internal flow vanes for generating a swirling fluid stream propagating about said flow divider and discharging through said exit or orifice.

65. The nozzle as set forth in claim 64, further including an annular chamber between said flow divider and said central bore of said nozzle housing, said annular chamber being in fluid communication with said swirl inducer and being in fluid communication with said exit orifice, said annular chamber further having a first diameter adjacent said swirl inducer being greater than a second diameter of said annular chamber adjacent to said exit orifice.

66. The nozzle as set forth in claim 63, wherein said central bore includes a flow transition region in fluid communication with said nozzle inlet; wherein said central aperture of said flow divider is in fluid communication with said flow transition region; and wherein said swirl inducer is in fluid communication with said flow transition region.

67. The nozzle as set forth in claim 66, wherein said swirl inducer includes internal flow vanes for generating a swirling fluid stream propagating about said flow divider and discharging through said exit or orifice.

68. The nozzle as set forth in claim 67, further including an annular chamber between said flow divider and said central bore of said nozzle housing, said annular chamber being in fluid communication with said swirl inducer and being in fluid communication with said exit orifice, said annular chamber further having a first diameter adjacent said swirl inducer being greater than a second diameter of said annular chamber adjacent to said exit orifice.

69. The nozzle as set forth in claim 63, wherein said swirl inducer includes at least one laterally extending spiral member formed between said flow divider and said central bore of said nozzle housing for generating a swirling fluid stream propagating about said flow divider and discharging through said exit orifice.

70. The nozzle as set forth in claim 69, further including an annular chamber between said flow divider and said central bore of said nozzle housing, said annular chamber being in fluid communication with said swirl inducer and being in fluid communication with said exit orifice, said annular chamber further having a first diameter adjacent said swirl inducer being greater than a second diameter of said annular chamber adjacent to said exit orifice.

71. A fluid nozzle for use in a drill bit, said nozzle comprising:

a nozzle housing having a central bore therethrough with a nozzle inlet and an exit orifice, said central bore for the passage of fluid through said nozzle housing;

means for discharging a portion of fluid passing through said central bore as a swirling stream;

means for discharging a portion of fluid passing through said central bore as an axial stream passing through the swirling stream discharged by said means for discharging a swirling stream; and said means for discharging an axial stream comprises a flow divider having a central aperture therethrough.

72. The nozzle as set forth in claim 71, wherein said means for forming a swirling stream comprises a swirl inducer for discharging a swirling fluid stream.

73. The nozzle as set forth in claim 72, wherein said swirl inducer includes internal flow vanes for generating a swirling fluid stream propagating about said flow divider and discharging through said exit or orifice.

74. The nozzle as set forth in claim 73, further including an annular chamber between said flow divider and said central bore of said nozzle housing, said annular chamber being in fluid communication with said swirl inducer and being in fluid communication with said exit orifice, said annular chamber further having a first diameter adjacent said swirl inducer being greater than a second diameter of said annular chamber adjacent to said exit orifice.

75. The nozzle as set forth in claim 72, wherein said central bore includes a flow transition region in fluid communication with said nozzle inlet; wherein said central aperture of said flow divider is in fluid communication with said flow transition region; and wherein said swirl inducer is in fluid communication with said flow transition region.

76. The nozzle as set forth in claim 75, wherein said swirl inducer includes internal flow vanes for generating a swirling fluid stream propagating about said flow divider and discharging through said exit or orifice.

77. The nozzle as set forth in claim 76, further including an annular chamber between said flow divider and said central bore of said nozzle housing, said annular chamber in fluid communication with said swirl inducer and being in fluid communication with said exit orifice, said annular chamber further having a first diameter adjacent said swirl inducer being greater than a second diameter of said annular chamber adjacent to said exit orifice.

78. The nozzle as set forth in claim 72, wherein said swirl inducer includes at least one laterally extending spiral member formed between said flow divider and said central bore of said nozzle housing for generating a swirling fluid stream propagating about said flow divider and discharging through said exit orifice.

79. The nozzle as set forth in claim 78, further including an annular chamber between said flow divider and said central bore of said nozzle housing, said annular chamber being in fluid communication with said swirl inducer and being in fluid communication with said exit orifice, said annular chamber further having a first diameter adjacent said swirl inducer being greater than a second diameter of said annular chamber adjacent to said exit orifice.

80. An apparatus comprising:

a housing adapted for movement relative to a surface;

means associated with said housing for the flow of fluid therethrough;

means associated with said housing for imparting a mechanical force to the surface;

at least one dual discharge fluid nozzle disposed in said housing and positioned in fluid communication with said fluid flow means for the discharge of a first, swirling fluid stream and a second, axial fluid stream in combination therewith;

wherein said at least one dual discharge fluid nozzle is disposed in said housing such that said second, axial fluid stream discharges against said surface;

wherein said at least one dual discharge fluid nozzle is disposed in said housing such that said first, swirling stream discharges against said surface; and further comprising at least one cleaning fluid nozzle disposed in said housing and positioned in fluid communication with said fluid flow means for the discharge of fluid against said means for imparting mechanical force to the surface.

81. The apparatus as set forth in claim 80, wherein said cleaning fluid nozzle discharges a swirling cleaning stream against said means for imparting mechanical force to the surface.

82. The apparatus as set forth in claim 80, wherein said cleaning fluid nozzle discharges an axial cleaning stream against said means for imparting mechanical force to the surface.

83. The apparatus as set forth in claim 82, wherein said cleaning fluid nozzle further discharges a swirling cleaning stream against said means for imparting mechanical force to the surface.

84. An apparatus comprising:

a housing adapted for movement relative to a surface;

means associated with said housing for the flow of fluid therethrough;

means associated with said housing for imparting a mechanical force to the surface;

at least one dual discharge fluid nozzle disposed in said housing and positioned in fluid communication with said fluid flow means for the discharge of a first, swirling fluid stream and a second, axial fluid stream in combination therewith;

wherein said at least one dual discharge fluid nozzle is disposed in said housing such that said first, swirling fluid stream engages said means for imparting mechanical force to the surface.

85. An apparatus comprising:

a housing adapted for movement relative to a surface;

means associated with said housing for the flow of fluid therethrough;

means associated with said housing for imparting a mechanical force to the surface;

at least one dual discharge fluid nozzle disposed in said housing and positioned in fluid communication with said fluid flow means for the discharge of a first, swirling fluid stream and a second, axial fluid stream in combination therewith;

wherein said at least one dual discharge fluid nozzle is disposed in said housing such that said first, swirling fluid stream engages said means for imparting mechanical force to the surface.

86. The apparatus as set forth in claim 85, wherein said at least one dual discharge fluid nozzle is further disposed in said housing such that said first, swirling fluid stream engages said means for imparting mechanical force to the surface.

87. The apparatus as set forth in claim 86, further comprising at least one surface fluid nozzle disposed in said housing and positioned in fluid communication with said fluid flow means for the discharge of fluid against said surface.

88. The apparatus as set forth in claim 87, wherein said at least one surface fluid nozzle discharges an axial surface fluid stream against said surface.

89. The apparatus as set forth in claim 87, wherein said at least one surface fluid nozzle discharges a swirling surface fluid stream against said surface.

90. The apparatus as set forth in claim 89, wherein said at least one surface fluid nozzle further discharges an axial surface fluid stream against said surface.

91. An apparatus comprising:

a housing adapted for movement relative to a surface;

means associated with the housing for the flow of fluid therethrough;

means associated with said housing for imparting mechanical force to the surface;

at least one dual discharge nozzle disposed in said housing and positioned in fluid communication with the fluid flow means for the discharge of a first, swirling fluid stream and a second, axial fluid stream in combination therewith; and wherein said means for imparting mechanical force comprises at least one roller cone.

92. The apparatus as set forth in claim 91, wherein said at least one dual discharge fluid nozzle is disposed in said housing such that said first, swirling fluid stream engages said at least one roller cone.

93. The apparatus as set forth in claim 92, wherein said at least one dual discharge fluid nozzle is disposed in said housing such that said second, axial fluid stream engages said at least one roller cone.

94. The apparatus as set forth in claim 91, wherein said at least one dual discharge fluid nozzle is disposed in said housing such that said second, axial fluid stream engages said at least one roller cone.

95. A method of drilling a surface with a drill bit utilizing a high velocity liquid jet, said method comprising the steps of:

providing a drill bit with a drill bit housing having at least one bore formed therein;

forming a dual-discharge nozzle for generating a first, swirling liquid jet, a second, axial liquid jet, said first, swirling liquid jet meeting said second, axial liquid jet before exiting said nozzle;

securing said nozzle in said housing in flow communication with said bore;

injecting liquid into said bore and into said nozzle and generating said first swirling liquid jet and a said second, axial liquid jet therewith; and discharging said liquid jets from said nozzle and against a surface.

96. The method according to claim 95, wherein said step of discharging said liquid jets includes discharging said liquid jets from about one-half of a nozzle diameter to about 10 nozzle diameters from said surface.

97. The method according to claim 95, wherein said step of forming a dual discharge nozzle includes forming a tapered annulus chamber for the generation of said first swirling liquid jet.

98. The method according to claim 97, wherein said step of forming a dual discharge nozzle includes forming at least one lateral vane for the propagation of liquid for the first, swirling liquid jet in a swirling direction prior to said tapered annulus chamber.

99. The method according to claim 97, wherein said step of forming a dual discharge nozzle includes forming a central body with a central bore for generating said second axial liquid jet and forming at least one flow vane around said central body for causing the propagation of liquid for the first, swirling liquid jet in a swirling direction prior to said tapered annulus chamber.

100. A method of drilling a surface with a drill bit utilizing a high velocity liquid jet, said method comprising the steps of:

providing a drill bit with a drill bit housing having at least one bore formed therein;

forming a dual-discharge nozzle for generating a first, swirling liquid jet with a tapered annulus chamber, and for generating at least one second, axial liquid jet in combination therewith, wherein;

securing said nozzle in said housing in flow communication with said bore;

injecting liquid into said bore and into said nozzle and generating said first swirling liquid jet and a said second, axial liquid jet therewith; and discharging said liquid jets from said nozzle and against said surface.

101. The method according to claim 100, wherein said step of discharging said liquid jets includes discharging said liquid jets from about one-half of a nozzle diameter to about 10 nozzle diameters from said surface.

102. The method according to claim 101, wherein said step of forming a dual discharge nozzle includes forming at least one lateral vane for the propagation of liquid for the first, swirling liquid jet in a swirling direction prior to said tapered annulus chamber.

103. The method according to claim 101, wherein said step of forming a dual discharge nozzle includes forming a central body with a central bore for generating said second axial liquid jet and forming flow vanes around said central body for causing the propagation of liquid for the first, swirling liquid jet in a swirling direction prior to said tapered annulus chamber.

104. An apparatus comprising:

a housing adapted for movement relative to a surface;

means associated with said housing for the flow of liquid therethrough;

at least one dual discharge liquid jet nozzle disposed in said housing and positioned in flow communication with said liquid flow means for the discharge of a first, swirling liquid jet and a second, axial jet in combination therewith, said first, swirling liquid jet meeting said second, axial jet before exiting said nozzle; and means for moving said housing relative to said surface.

105. The apparatus according to claim 104, wherein said dual discharge nozzle includes a tapered annulus chamber for the generation of said first swirling liquid jet.

106. The apparatus according to claim 105, wherein said dual discharge nozzle includes at least one lateral vane for the propagation of liquid for the first, swirling liquid jet in a swirling direction prior to said tapered annulus chamber.

107. The apparatus according to claim 105, wherein said dual discharge nozzle includes a central body with a central bore for generating said second axial liquid jet and at least one flow vane around said central body for causing the propagation of liquid for the first, swirling liquid jet in a swirling direction prior to said tapered annulus chamber.

108. An apparatus comprising:

a housing adapted for movement relative to a surface;

means associated with said housing for the flow of liquid therethrough;

at least one dual discharge liquid jet nozzle disposed in said housing and positioned in flow communication with said liquid flow means for the discharge of a first, swirling liquid jet and a second, axial jet in combination therewith, said nozzle having a tapered annulus in which liquid for the first, swirling liquid jet passes prior to exiting said nozzle; and means for moving said housing relative to said surface.

109. The apparatus according to claim 108, wherein said dual discharge nozzle includes at least one lateral vane for the propagation of the liquid for the first, swirling liquid jet in a swirling direction prior to said tapered annulus chamber.

110. The apparatus according to claim 108, wherein said dual discharge nozzle includes a central body with a central bore for generating said second axial liquid jet and at least one flow vane around said central body for causing the propagation of the liquid for the first, swirling liquid jet in a swirling direction prior to said tapered annulus chamber.

111. A fluid nozzle for use in a drill bit, said nozzle comprising:

a nozzle housing having a central bore therethrough with a nozzle inlet and an exit orifice, said central bore for the passage of fluid through said nozzle housing;

means for discharging a portion of fluid passing though said central bore as a swirling stream;

means for discharging a portion of fluid passing through said central bore as an axial stream passing through the swirling stream discharged by said means for discharging a swirling stream; and means for causing said swirling stream to meet with said axial stream prior to exiting said nozzle.

112. The apparatus according to claim 111, wherein said means for discharging the portion of said fluid as a swirling stream includes a tapered annulus chamber for the passage of the liquid.

113. The apparatus according to claim 112, wherein said means for discharging the portion of said fluid as a swirling stream includes at least one lateral vane for the propagation of the liquid in a swirling direction prior to said tapered annulus chamber.

114. The apparatus according to claim 112, wherein said means for discharging a portion of fluid as an axial stream includes a central body with a central aperture therethrough and wherein said means for discharging the portion of the fluid as a swirling stream includes at least one flow vane around said central body for causing the propagation of the liquid for the swirling stream in a swirling direction prior to said tapered annulus chamber.

115. A fluid nozzle for use in a drill bit, said nozzle comprising:

a nozzle housing having a central bore therethrough with a nozzle inlet and an exit orifice, said central bore for the passage of fluid through said nozzle housing;

means for discharging a portion of fluid passing though said central bore as a swirling stream including a tapered annulus chamber; and means for discharging a portion of fluid passing through said central bore as an axial stream passing through the swirling stream discharged by said means for discharging a swirling stream.

116. The apparatus according to claim 115, wherein said means for discharging the portion of said fluid as a swirling stream includes at least one lateral vane for the propagation of the liquid in a swirling direction prior to said tapered annulus chamber.

117. The apparatus according to claim 115, wherein said means for discharging a portion of fluid as an axial stream includes a central body with a central aperture therethrough and wherein said means for discharging the portion of the fluid as a swirling stream includes at least one flow vane around said central body for causing the propagation of the liquid for the swirling stream in a swirling direction prior to said tapered annulus chamber.

118. A fluid nozzle for use in a drill bit, said nozzle comprising:

a nozzle head having an central aperture therethrough;

a central body with a central bore therethrough, said central body positioned within said central aperture of said nozzle head to form a tapered annulus chamber;

a swirl inducer positioned to induce a portion of a liquid passing through said fluid nozzle to propagate in a swirling direction before passing through the tapered annulus chamber between said nozzle head and said central body.

119. The fluid nozzle according to claim 118, wherein said swirl inducer comprises at least one lateral vane.

120. The fluid nozzle according to claim 118, wherein said swirl inducer comprises at least one flow vane around said central body.

121. The fluid nozzle according to claim 118, wherein said central body further includes being positioned to provide a cylindrical exit chamber for fluid from said tapered annular chamber between said nozzle header and said central body to meet with fluid from said central bore of said central body before exiting said nozzle.

* * * * *

UNITED STATES PATENT AND TRADEMARK OFFICE

CERTIFICATE OF CORRECTION

PATENT NO. : 5,862,871

DATED : Jan. 26, 1999

INVENTOR(S) : Curlett

It is certified that error appears in the above-identified patent and that said Letters Patent is hereby corrected as shown below:

| | |
|---|---|
| Column 10, line 22 | Replace "as step"<br>With --as set-- |
| Column 13, line 44 | Replace "said"<br>With --a-- |
| Column 16, line 12 | Replace "inducer"<br>With --swirl inducer-- |

Signed and Sealed this

Sixteenth Day of November, 1999

*Attest:*

Q. TODD DICKINSON

*Attesting Officer*

*Acting Commissioner of Patents and Trademarks*